US010364595B2

(12) United States Patent
Sundberg et al.

(10) Patent No.: US 10,364,595 B2
(45) Date of Patent: Jul. 30, 2019

(54) ACCESS-CONTROL FIXTURE LOCK

(71) Applicant: Dorel Juvenile Group, Inc., Foxboro, MA (US)

(72) Inventors: Brian C Sundberg, Chester, NH (US); Laura Kay Raffi, Holliston, MA (US); Alice Mayfield, San Francisco, CA (US); Scott E Stropkay, Carlisle, MA (US); Mark Matthews, Scituate, MA (US); Evan Hutker, Cambridge, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 655 days.

(21) Appl. No.: 15/040,538

(22) Filed: Feb. 10, 2016

(65) Prior Publication Data

US 2016/0230422 A1 Aug. 11, 2016

Related U.S. Application Data

(60) Provisional application No. 62/114,122, filed on Feb. 10, 2015.

(51) Int. Cl.
*E05B 63/00* (2006.01)
*E05B 1/00* (2006.01)
(Continued)

(52) U.S. Cl.
CPC ..... *E05B 63/0043* (2013.01); *E05B 1/0007* (2013.01); *E05B 37/20* (2013.01); *E05B 67/003* (2013.01); *E05B 67/22* (2013.01); *E05C 7/00* (2013.01); *E05C 19/18* (2013.01); *E05B 1/0015* (2013.01); *E05B 53/003* (2013.01)

(58) Field of Classification Search
CPC ..... Y10T 24/1498; Y10T 292/0902; Y10T 292/34; Y10T 70/5004; Y10T 292/505; Y10T 24/318; Y10T 292/17; E05B 65/0014; E05B 63/0043; Y10S 292/65; B65D 2215/00
See application file for complete search history.

(56) References Cited

U.S. PATENT DOCUMENTS 4,570,470 A 2/1986 Gray, Sr.
5,337,459 A 8/1994 Hogan
(Continued)

FOREIGN PATENT DOCUMENTS

CN 203499363 U 3/2014
CN 103872517 A 6/2014
EP 0301143 A1 2/1989

OTHER PUBLICATIONS

PCT International Search Report and Written Opinion completed by the ISA/US on Mar. 23, 2016 and issued in connection with PCT/US2016/017355.
(Continued)

*Primary Examiner* — Mark A Williams
(74) *Attorney, Agent, or Firm* — Barnes & Thornburg LLP

(57) ABSTRACT

A fixture lock is provided to lock two movable parts of a fixture so that one part may not be moved relative to another part to gain access to a receptacle formed in the fixture. The fixture lock could be used to lock a cabinet drawer in a closed position in a cabinet base to block access to a storage region formed in the cabinet drawer.

23 Claims, 18 Drawing Sheets

(51) Int. Cl.

| | |
|---|---|
| ***E05B 37/20*** | (2006.01) |
| ***E05B 67/00*** | (2006.01) |
| ***E05B 67/22*** | (2006.01) |
| ***E05C 19/18*** | (2006.01) |
| ***E05C 7/00*** | (2006.01) |
| *E05B 53/00* | (2006.01) |

(56) References Cited

U.S. PATENT DOCUMENTS 5,423,583 A * 6/1995 Crockom ..... E05B 17/142 292/1
5,425,256 A * 6/1995 Crosby ..... E05B 13/001 292/DIG. 2
5,485,733 A 1/1996 Hoffman
5,568,951 A * 10/1996 Morgan ..... B65D 55/02 283/98
5,588,687 A * 12/1996 Pinkerton ..... E05B 15/1607 292/259 R
5,769,517 A * 6/1998 Carde ..... E05B 65/0014 292/238
7,578,532 B2 * 8/2009 Schiebler ..... G09F 3/0311 292/307 A
7,798,543 B1 * 9/2010 Gordon ..... E05B 67/08 292/307 R
8,282,140 B1 10/2012 Joy
2003/0126896 A1 7/2003 Mori
2006/0101876 A1 5/2006 Timothy
2006/0202484 A1 * 9/2006 Lignell ..... E05B 13/001 292/1
2009/0188693 A1 * 7/2009 Simmons ..... H02G 3/14 174/67
2013/0025510 A1 1/2013 White
2016/0168892 A1 * 6/2016 Raffi ..... E05C 19/188 292/325
2016/0230417 A1 * 8/2016 Sundberg ..... E05B 1/0007

OTHER PUBLICATIONS

PCT International Search Report and Written Opinion completed on Mar. 23, 2016 and issued in connection with PCT/US2016/017355.
Chinese Office Action corresponding to 2016800140767 dated Oct. 15, 2018.
PCT International Search Report and Written Opinion completed by the ISA/US on Mar. 23, 2016 and issued in connection with PCT/US2016/017357.
PCT International Preliminary Report on Patentability dated Aug. 15, 2017 in connection with PCT/US2016/017357.
PCT International Preliminary Report on Patentability dated Aug. 15, 2017 in connection with PCT/US2016/017355.

* cited by examiner

ACCESS-CONTROL FIXTURE LOCK

PRIORITY CLAIM

This application claims priority under 35 U.S.C. § 119(e) to U.S. Provisional Application No. 62/114,122, filed Feb. 10, 2015, which is expressly incorporated by reference herein.

BACKGROUND

The present disclosure relates to a lock system, and in particular, to an access-control lock system. More particularly, the present disclosure relates to a fixture security system that can be used easily by caregivers, but not by young children, to control access to receptacles formed in cabinets and other fixtures.

SUMMARY

A fixture security system is adapted to be coupled to a fixture having a receptacle to block access by children to the receptacle formed in the fixture. The fixture includes a first portion and a second portion that can be moved relative to the first portion to gain access to the receptacle. In illustrative embodiments, the fixture is a cabinet, the first portion is a cabinet base, and the second portion is a cabinet door or drawer. It is within the scope of the present disclosure to employ the fixture security system disclosed herein with a wide variety of fixtures and relatively movable portions of fixtures.

In illustrative embodiments, the fixture security system includes a fixture lock unit and a lock-unit anchor that cooperate to block relative movement of the first and second portions of the fixture when the fixture lock unit is locked. The fixture lock unit is configured to allow relative movement of the first and second portions of the fixture to gain access to the receptacle formed in the fixture when the fixture lock unit is unlocked.

In illustrative embodiments, an operative movable lock actuator is included in the fixture lock unit and associated with a lock also included in the fixture lock unit. This operative movable lock actuator can be moved by a person to actuate the lock and thereby unlock the fixture lock unit.

In illustrative embodiments, a fixture security system comprises a child-resistant, access-control unit mounted on a fixture lock unit in accordance with the present disclosure to conceal the operative movable lock actuator and provide a non-operative visible and movable DECOY lock-actuator button that will be seen by children. Unknowing children can see and push the non-operative movable DECOY lock-actuator button included in the child-restraint, access control unit repeatedly without moving the concealed operative movable lock actuator included in the fixture lock unit that must be moved to actuate the lock and unlock the fixture lock unit to gain access to the receptacle formed in the fixture. Knowing caregivers can push inwardly on an exterior surface of the child-resistant, access-control unit to cause the concealed operative movable lock actuator that is located underneath that exterior surface to move to actuate the lock and thus unlock the fixture lock unit because they have been taught where to push.

In illustrative embodiments, the child-resistant, access-control unit includes a lock-actuator mask and a non-operative DECOY lock-actuator button. The lock-actuator mask is arranged to cover a portion of the fixture lock unit to hide the operative movable lock actuator so that it cannot be seen by young unknowing children. The non-operative DECOY lock-actuator button is mounted in an unconcealed visible location on the lock-actuator mask for movement relative to the lock-actuator mask. A young child attempting to play with or unlock the fixture lock unit will see only the visible and movable non-operative DECOY lock-actuator button carried on the lock-actuator mask that covers the fixture lock unit. Movement of the visible non-operative DECOY lock-actuator button relative to the lock-actuator mask by an unknowing child or other person does not cause the concealed operative movable lock actuator to move to actuate the lock in the fixture lock unit so that the fixture lock unit remains locked and the receptacle formed in the fixture is not accessible.

In illustrative embodiments, a force-transmission section of the lock-actuator mask adjacent to the concealed operative movable latch actuator is made of a deformable elastic material. A symbol may be provided on an exterior surface of the lock-actuator mask to inform a caregiver of the location of the concealed operative movable latch actuator under the force-transmission section of lock-actuator mask. An external pushing force applied by a knowing caregiver to the force-transmission section of the lock-actuator mask causes that section to deform elastically and apply a motion-inducing force to the underlying concealed operative movable lock actuator that is sufficient to move the lock actuator to actuate the lock included in the fixture lock unit so as to unlock the fixture lock unit. In illustrative embodiments, the entire lock-actuator mask is made of the deformable elastic material.

In illustrative embodiments, the fixture security system includes a lock-unit anchor that is adapted to mate with a first portion (e.g. cabinet base) of the fixture and a fixture lock unit that is coupled to the lock-unit anchor and is adapted to mate with a second portion (e.g. cabinet door or drawer) of the fixture. When the fixture lock unit is locked there is no relative movement between the first and second portions of the fixture so that access to the receptacle formed in the fixture is blocked.

In illustrative embodiments, the fixture lock unit includes a fixture link that is adapted to be coupled permanently or temporarily to a second portion of the fixture and a lock that is tethered to the first portion of the fixture by the lock-unit anchor and that is configured to engage and disengage the fixture link as the fixture lock unit is locked and unlocked. The lock normally engages the fixture link to lock the fixture lock unit and thereby block access to the article-storage receptacle formed in the fixture owing to cooperation of the fixture lock unit and the lock-unit anchor to block relative movement of the first and second portions of the fixture. The fixture lock unit also includes an operative movable lock actuator coupled to the lock and mounted for movement by a caregiver to actuate the lock to cause the lock to disengage the fixture link so that the lock can be separated from the fixture link to unlock the fixture lock unit and allow relative movement of the first and second portions of the fixture to allow access to the article-storage receptacle formed in the fixture.

In some illustrative embodiments, the fixture is a cabinet having a movable door covering an opening into an article-storage receptacle formed in the base of the cabinet and the fixture security system locks the movable door to the cabinet base so that the door cannot be opened by pushing the visible and movable non-operative DECOY lock-actuator button that is provided but only by pushing the concealed operative movable lock actuator that is hidden under that lock-actuator mask on which the non-operative DECOY lock-actuator button is mounted. In other illustrative embodiments, the fixture is a cabinet that has a slidable drawer that is movable relative to the base of the cabinet to expose an article-storage receptacle formed in the sliding drawer. In further illustrative embodiments, the fixture is a cabinet having movable side-by-side doors cooperatively covering, when closed, an opening into an article-storage receptacle formed in a base of the cabinet.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 5 is a perspective view of an illustrative first all-purpose strap lock in accordance with the present disclosure including a visible and movable non-operative DECOY lock-actuator button mounted on a lock-actuator mask made of an opaque material and formed to include a symbol (e.g., three raised bumps) to identify the location of the concealed operative movable lock actuator that is located under the opaque lock-actuator mask;

FIG. 6 is a perspective view of an illustrative second all-purpose strap lock in accordance with the present disclosure including a visible and removable non-operative DECOY lock-actuator button mounted on a lock-actuator mask made of a translucent material and arranged to cover the underlying concealed movable lock actuator;

FIG. 7 is a perspective view of an illustrative third all-purpose strap lock in accordance with the present disclosure including a visible and movable non-operative DECOY lock-actuator button mounted on a lock-actuator mask made of an opaque material;

FIG. 8 is another perspective view of the all-purpose strap lock of FIG. 7;

DETAILED DESCRIPTION

Figure 1:
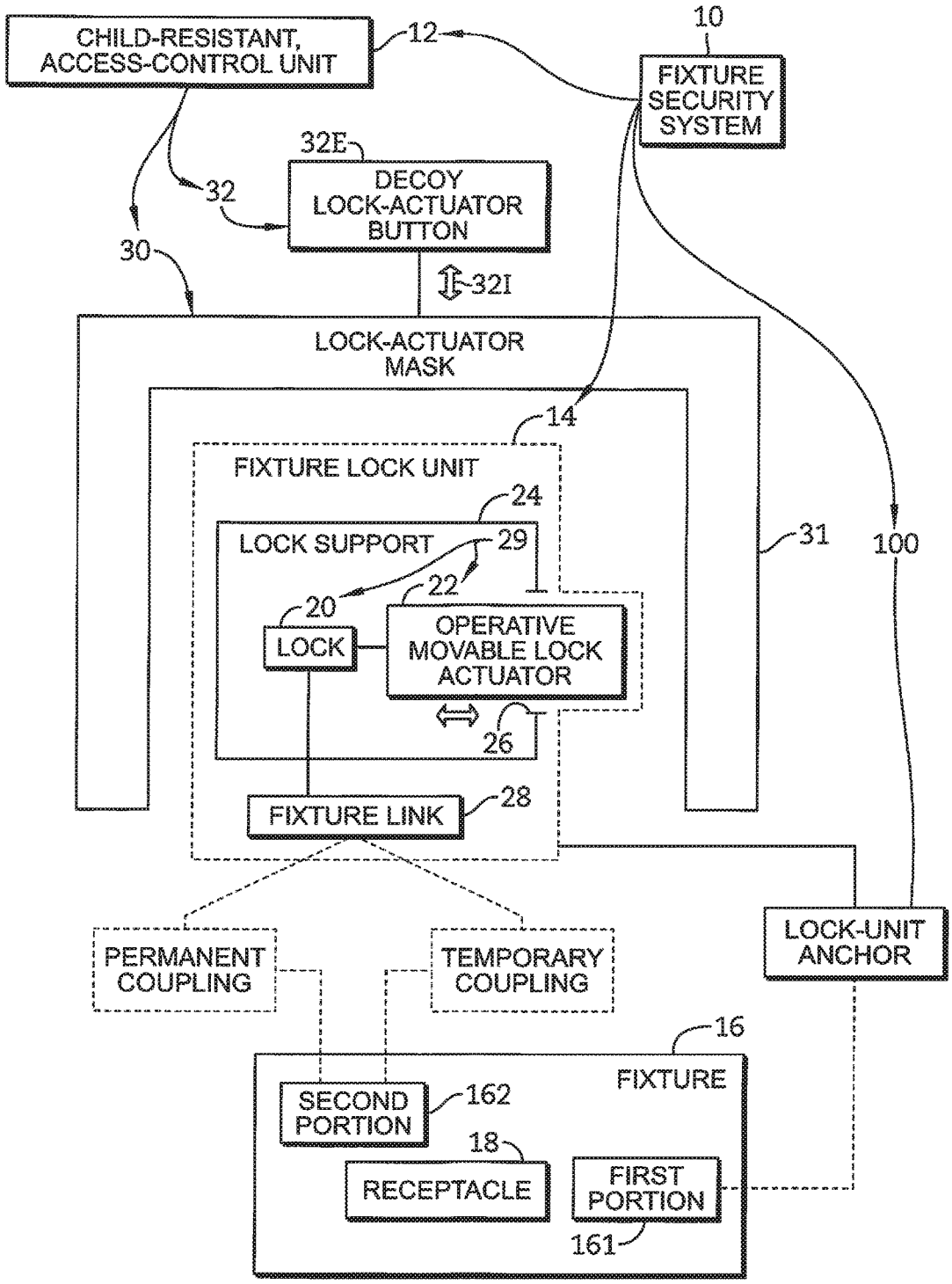
FIG. 1 is a diagrammatic view of a fixture security system including a child-resistant, access-control unit in accordance with the present disclosure coupled to a fixture lock unit associated with a fixture (e.g. cabinet) having a receptacle and suggesting that the child-resistant, access-control unit includes (1) a lock-actuator mask mounted on the fixture lock unit to conceal an operative movable lock actuator that must be moved by a person to actuate the lock and unlock the fixture lock unit and (2) a non-operative DECOY lock-actuator button mounted in an unconcealed visible location on the lock-actuator mask for movement relative to the lock-actuator mask when pushed by an unknowing child or other person without causing movement of the concealed operative movable lock actuator of the fixture lock unit to actuate the lock and unlock the fixture lock unit so that access to the receptacle formed in the fixture is denied to a child that pushes the non-operative DECOY lock-actuator button repeatedly and also suggesting that the fixture security system also includes a lock-unit anchor coupled to the fixture lock unit and adapted to be coupled to a first portion of the fixture and that the fixture lock unit includes a fixture link that can be coupled permanently or temporarily to a second portion of the fixture, a lock associated with the fixture, and an operative movable lock actuator associated with the lock.

A fixture security system 10 includes an access-control unit 12 comprising a non-operative DECOY lock-actuator button 32 as suggested diagrammatically in FIG. 1. It is within the scope of the present disclosure to provide a DECOY lock-actuator button 32 that is made of an elastic deformable material that is configured normally to assume an undepressed (i.e. projected or raised) position and that is deformable elastically to move relative to the lock-actuator mask 30 to assume a depressed position when exposed to an external downward pushing force. DECOY lock-actuator button 32 includes a visible outer fingertip end 32E arranged to be touched by a finger of a child attempting to actuate lock 20 and thereby unlock fixture lock unit 14 covered by the outer shell 30 as suggested in FIG. 2. Several non-operative DECOY lock-actuator buttons in accordance with the present disclosure are shown, for example, in FIGS. 1A-1I.

Access-control unit 12 is mounted on a fixture lock unit 14 that is adapted to lock a fixture 16 so that a child is unable to gain access to a receptacle 18 formed in fixture 16 as suggested diagrammatically in FIGS. 1-4. Fixture lock unit 14 includes a lock 20 that is operable to block relative movement of two portions 161, 162 of a fixture 16 to block access to the receptacle 18 formed in the fixture 16 and can be actuated to unlock fixture lock unit 14 only by movement of an operative movable lock actuator 22 as suggested in FIG. 4. Other illustrative fixture security systems are shown in FIGS. 5-8, 10, and 12.

Access-control unit 12 includes a lock-actuator mask 30 and a visible and movable non-operative DECOY lock-actuator button 32 as suggested diagrammatically in FIGS. 1-4. Lock-actuator mask 30 is arranged to cover fixture lock unit 14 to conceal operative movable lock actuator 22 from view. The non-operative DECOY lock-actuator button 32 is mounted in a visible location on lock-actuator mask 30 for movement relative to lock-actuator mask 30 from a normal projected position to a temporary depressed position so that unknowing children and other persons are drawn to it and repeatedly push it inwardly as suggested in FIGS. 2 and 3 in a series of unsuccessful efforts to actuate and unlock lock 20 in fixture lock unit 14 without ever discovering the location of the concealed operative movable lock actuator 22 under the lock-actuator mask 30.

A person can move the concealed movable lock actuator 22 to actuate and unlock lock 20 with proper education. Caregivers are taught in accordance with the present disclosure to apply an external force to a force-transmission section 301 of lock-actuator mask 30 as suggested in FIG. 4 to cause that section 301 to deform and transfer a motion-inducing force to the underlying concealed operative movable lock actuator 22 to cause that lock actuator 22 to move and actuate lock 20 and thereby unlock fixture lock unit 14.

Lock-actuator mask 30 of access-control unit 12 can be sized and shaped in accordance with the present disclosure to cover a wide variety of fixture locks so as to conceal from view a lock actuator included in such fixture locks as suggested in FIGS. 5-14. Lock-actuator mask 30 is formed to host the visible and relatively movable non-operative DECOY lock-actuator button 32 as suggested diagrammatically in FIGS. 2 and 3.

Figure 2:
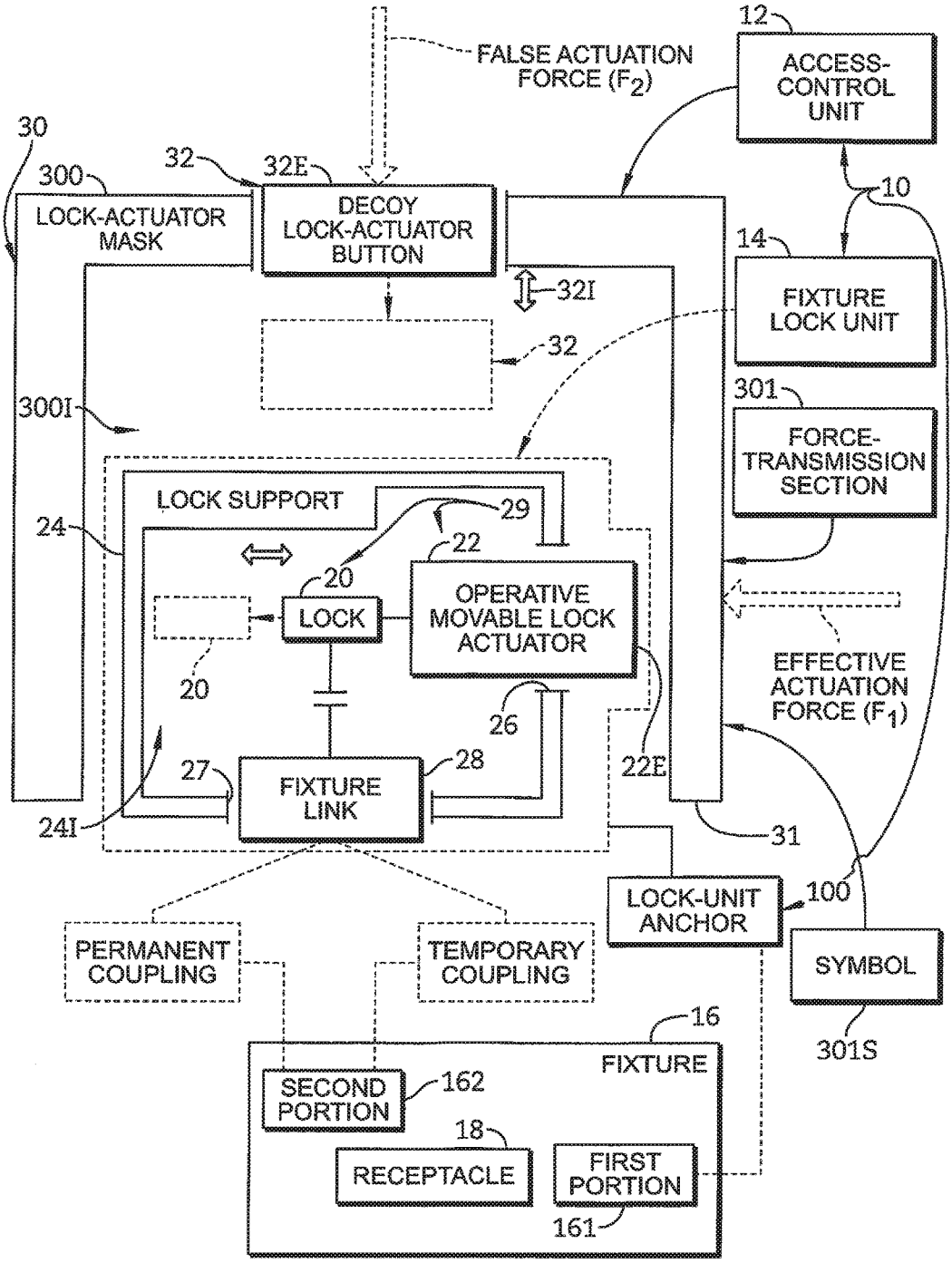
FIG. 2 is a diagrammatic view of a fixture having a receptacle and an illustrative fixture security system in accordance with the present disclosure and showing that the fixture security system comprises a lock-unit anchor adapted to mate with a first portion of the fixture, a fixture lock unit including a lock support formed to include an actuator aperture and an inner link-receiver inlet, a fixture link adapted to mate with a second portion of the fixture permanently or temporarily and arranged to extend through the inner-link receiver inlet into an interior region formed in the lock support normally to engage a lock that is located in the interior region of the lock support, and an operative movable lock actuator mounted for movement in the actuator aperture formed in the lock support under the control of a knowing caregiver as suggested in FIG. 4 to actuate the lock by disengaging the lock from the fixture link to unlock the fixture lock unit so that the lock support of the fixture lock unit can be moved relative to the second portion of the fixture while the lock-unit anchor remains mated with the first portion of the fixture to unblock access to the receptacle formed in the fixture and showing that the fixture security system further comprises an access-control unit including a lock-actuator mask arranged to surround the lock support to conceal the operative movable lock actuator from view and a visible DECOY lock-actuator button mounted in an unconcealed visible location for movement relative to the lock-actuator mask (e.g., in a button-receiving aperture formed in the lock-actuator mask) without causing any movement of the operative movable lock actuator to actuate the lock and unlock the fixture lock unit.

Lock-actuator mask 30 includes an outer shell 300 that is formed to support the non-operative DECOY lock-actuator button 32 and a force-transmission section 301 that is coupled to outer shell 300 and arranged to lie in confronting relation to the operative movable lock actuator 22 of fixture lock unit 14 as suggested diagrammatically in FIG. 2. In some illustrative embodiments, outer shell 300 and force-transmission section 301 cooperate to form a monolithic member made of a deformable elastic plastics material. In other illustrative embodiments, force-transmission section 301 is made of a deformable elastic plastics material while outer shell 300 is made of a relatively rigid material. In some embodiments, lock-actuator mask 30 is made of an opaque material as suggested in FIG. 5 to provide means for blocking visibility of the lock actuator 22 concealed under the lock-actuator mask 30 while in other embodiments lock-actuator mask 30 is made of a translucent material as suggested in FIG. 6 to provide means for obscuring visibility of the lock actuator 22 concealed under the lock-actuator mask 30.

Figure 1A:
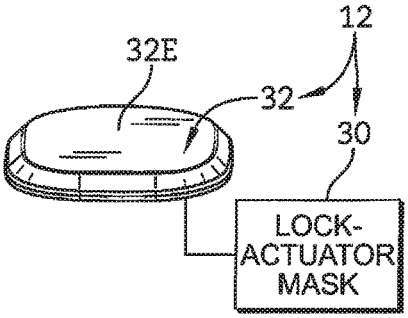
FIGS. 1A and 1B show an illustrative first embodiment of a non-operative DECOY lock-actuator button that is coupled to a lock-actuator mask in accordance with the present disclosure and is made of an elastic deformable material and is configured normally to assume a normal projected position shown in FIG. 1A and is deformable elastically when exposed to an external force to assume a temporary depressed position as suggested in FIG. 1B.
Figure 1B:
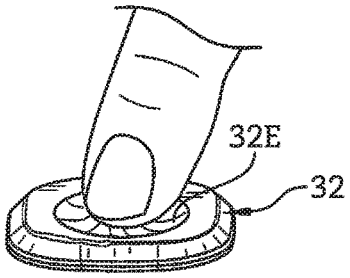

A first embodiment of a non-operative DECOY lock-actuator button 32 is illustrated in FIGS. 1A and 1B and is configured to be coupled to a lock-actuator mask 30 in accordance with the present disclosure to form a child-resistant access-control unit 12. The non-operative DECOY lock-actuator button 32 is made of an elastic deformable material and is configured normally to assume a normal projected position shown in FIG. 1A and is deformable elastically when exposed to an external force to assume a temporary depressed position as suggested in FIG. 1B.

Figure 1C:
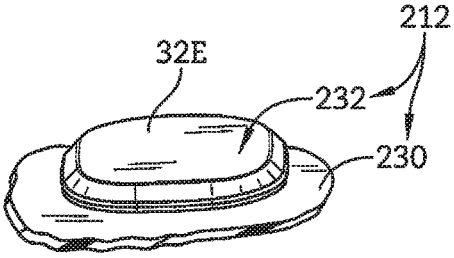
FIGS. 1C and 1D show an illustrative second embodiment of a non-operative DECOY lock-actuator button in accordance with the present disclosure that cooperates with a lock-actuator mask in accordance with the present disclosure to form a monolithic component made of an elastic deformable material and showing that the non-operative DECOY lock-actuator button is configured normally to assume a normal projected position shown in FIG. 1C and is deformable elastically when exposed to an external force to assume a temporary depressed position as suggested in FIG. 1D.
Figure 1D:
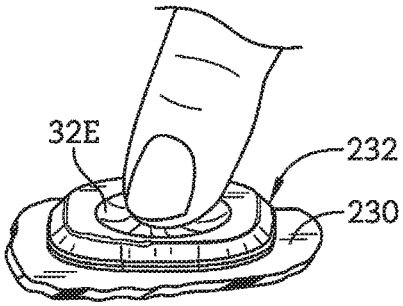

A second embodiment of a non-operative DECOY lock-actuator button 232 is illustrated in FIGS. 1C and 1D. The non-operative DECOY lock-actuator button 232 cooperates with a lock-actuator mask 230 in accordance with the present disclosure to form a monolithic component made of an elastic deformable material. The non-operative DECOY lock-actuator button 232 also cooperates with lock-actuator mask 230 to form a child-resistant access-control unit 212. The non-operative DECOY lock-actuator button is configured normally to assume a normal projected position shown in FIG. 1C and is deformable elastically when exposed to an external force to assume a temporary depressed position as suggested in FIG. 1D.

Figure 1E:
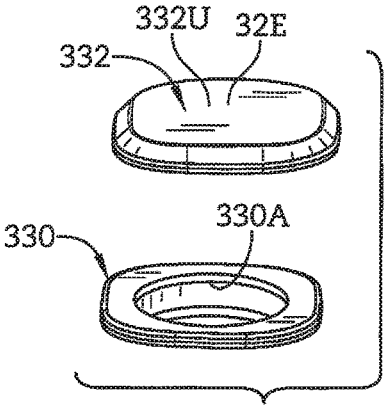
FIGS. 1E-1G show an illustrative third embodiment of a non-operative DECOY lock-actuator button in accordance with the present disclosure in which the lock-actuator mask is formed to include a central aperture that is arranged to underlie the non-operative DECOY lock-actuator button, the non-operative DECOY lock-actuator button is made of an elastic deformable material as suggested in FIG. 1E and is arranged to mate with a portion of an upwardly facing top wall of the lock-actuator mask to overlie the central aperture as suggested in FIG. 1F, and an unsupported portion of the non-operative DECOY lock-actuator button is arranged to move downwardly into the central aperture formed in the lock-actuator mask as suggested in FIG. 1G during movement of the non-operative DECOY lock-actuator button from the normal projected position shown in FIG. 1F to the temporary depressed position in response to exposure of an upwardly facing exterior surface of the unsupported portion to a downwardly directed external force as suggested in FIG. 1G.
Figure 1F:
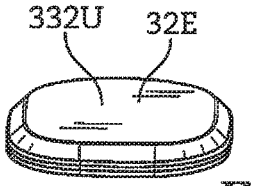
Figure 1G:
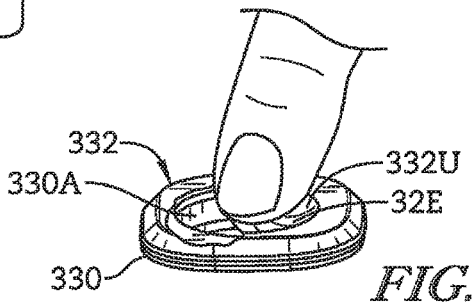

A third embodiment of a non-operative DECOY lock-actuator button 332 in accordance with the present disclosure as shown in FIGS. 1E-1G. A lock-actuator mask 330 is formed to include a central aperture 330A that is arranged to underlie the non-operative DECOY lock-actuator button 332 as suggested in FIG. 1E. The non-operative DECOY lock-actuator button 332 is made of an elastic deformable material as suggested in FIG. 1E and is arranged to mate with a portion of an upwardly facing top wall of the lock-actuator mask 330 to overlie the central aperture as suggested in FIG. 1F. An unsupported portion 332U of the non-operative DECOY lock-actuator button 332 is arranged to move downwardly into the central aperture 330A formed in lock-actuator mask 330 as suggested in FIG. 1G during movement of the non-operative DECOY lock-actuator button 332 from the normal projected position shown in FIG. 1F to the temporary depressed position in response to exposure of an upwardly facing exterior surface 32E of the unsupported portion 332U to a downwardly directed external force as suggested in FIG. 1G.

Figure 1H:
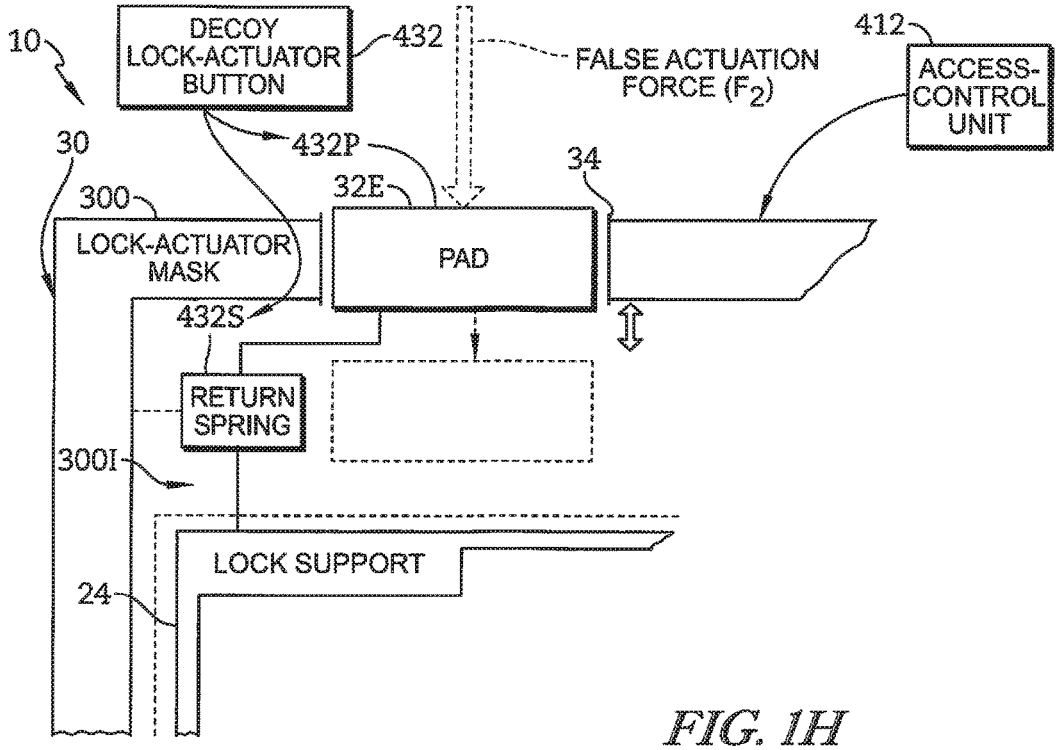
FIGS. 1H and 1I show an illustrative fourth embodiment of a non-operative DECOY lock-actuator button in accordance with the present disclosure in which the lock-actuator mask is formed to include a button-receiving aperture and the non-operative DECOY lock-actuator button normally is supported in the normal projected position by a return spring as suggested in FIG. 1H and the return spring is configured to provide means for yieldably urging the non-operative DECOY lock-actuator button to move relative to the lock-actuator mask from the temporary depressed position suggested in FIG. 1I to the normal projected position suggested in FIG. 1H so that the non-operative DECOY lock-actuator button will be returned automatically to the normal projected position after being pushed by a child or other person attempting to use the non-operative DECOY lock-actuator button to actuate the lock and unlock the fixture lock unit covered by the lock-actuator mask.
Figure 1I:
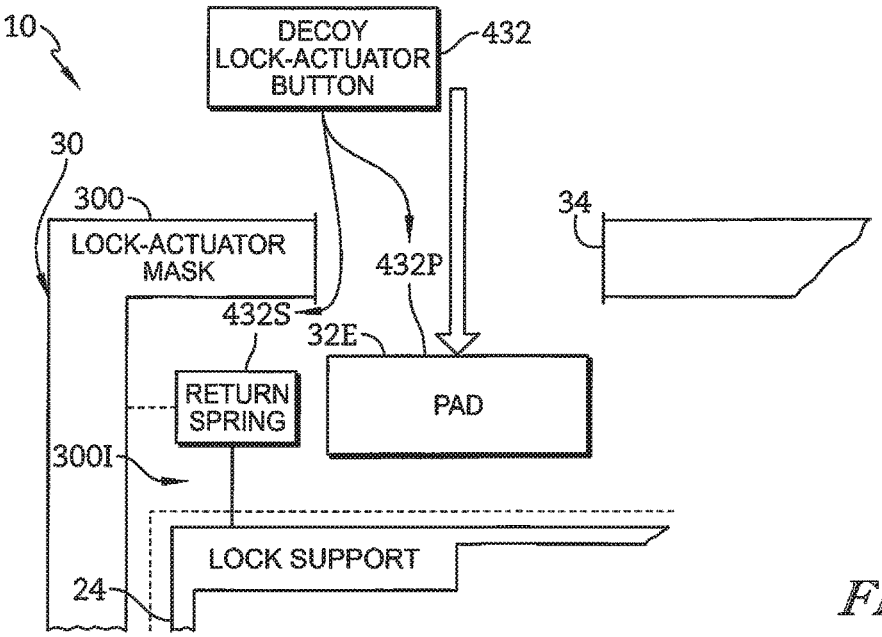

A fourth embodiment of a non-operative DECOY lock-actuator button 432 includes a pad 432P and a pad-return spring 432S as suggested in FIGS. 1H and 1I. Spring 302 is arranged to lie in interior region 3001 of outer shell 300 and is configured to provide means for yieldably urging pad 432P upwardly through an aperture 34 formed in outer shell 300 so that the visible outer fingertip end 32E of button 432 on pad 432P can be seen and touched by a child or anyone viewing access-control unit 12 as suggested in FIGS. 2-4. The non-operative DECOY lock-actuator button 432 cooperates with lock-actuator mask 300 to form a child-resistant, access-control unit 412. The pad-return spring 432S is configured to urge pad 432 to move relative to lock-actuator mask 300 away from the temporary depressed position shown in FIG. 1I to the normal projected position shown in FIG. 1H so that the non-operative DECOY lock-actutator button 432 will be returned automatically to the normal projected position after being pushed by a child attempting to use the non-operative DECOY lock-actuator button 432 to actuate lock 12 and unlock a fixture lock unit 14 covered by lock-actuator mask 300.

Figure 3:
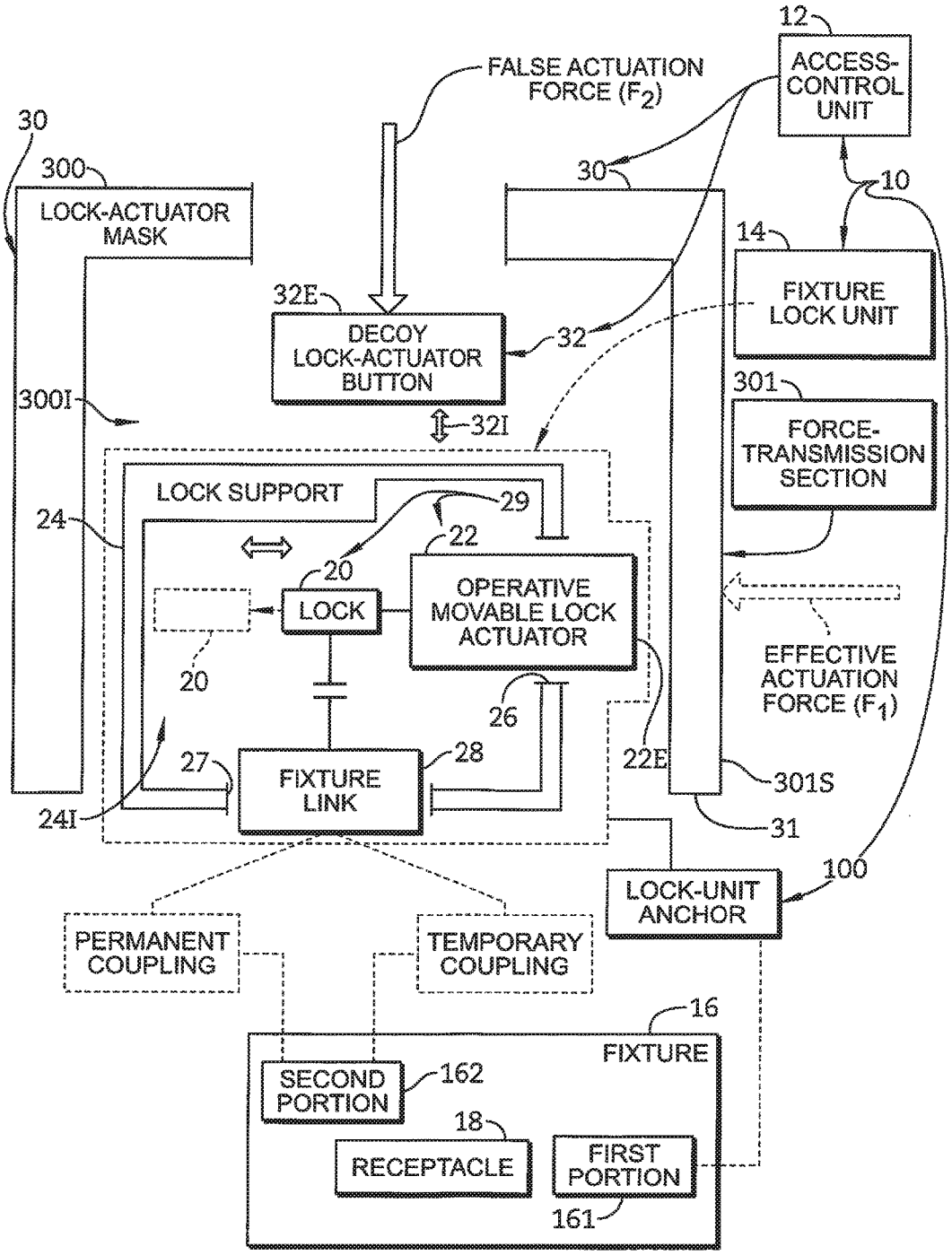
FIG. 3 is a view similar to FIG. 2 showing that a unknowing child has moved the visible non-operative DECOY latch actuator button relative to the lock-actuator mask without causing movement of the concealed operative movable lock actuator to cause the lock to disengage the fixture link so that the fixture lock unit remains locked.
Figure 4:
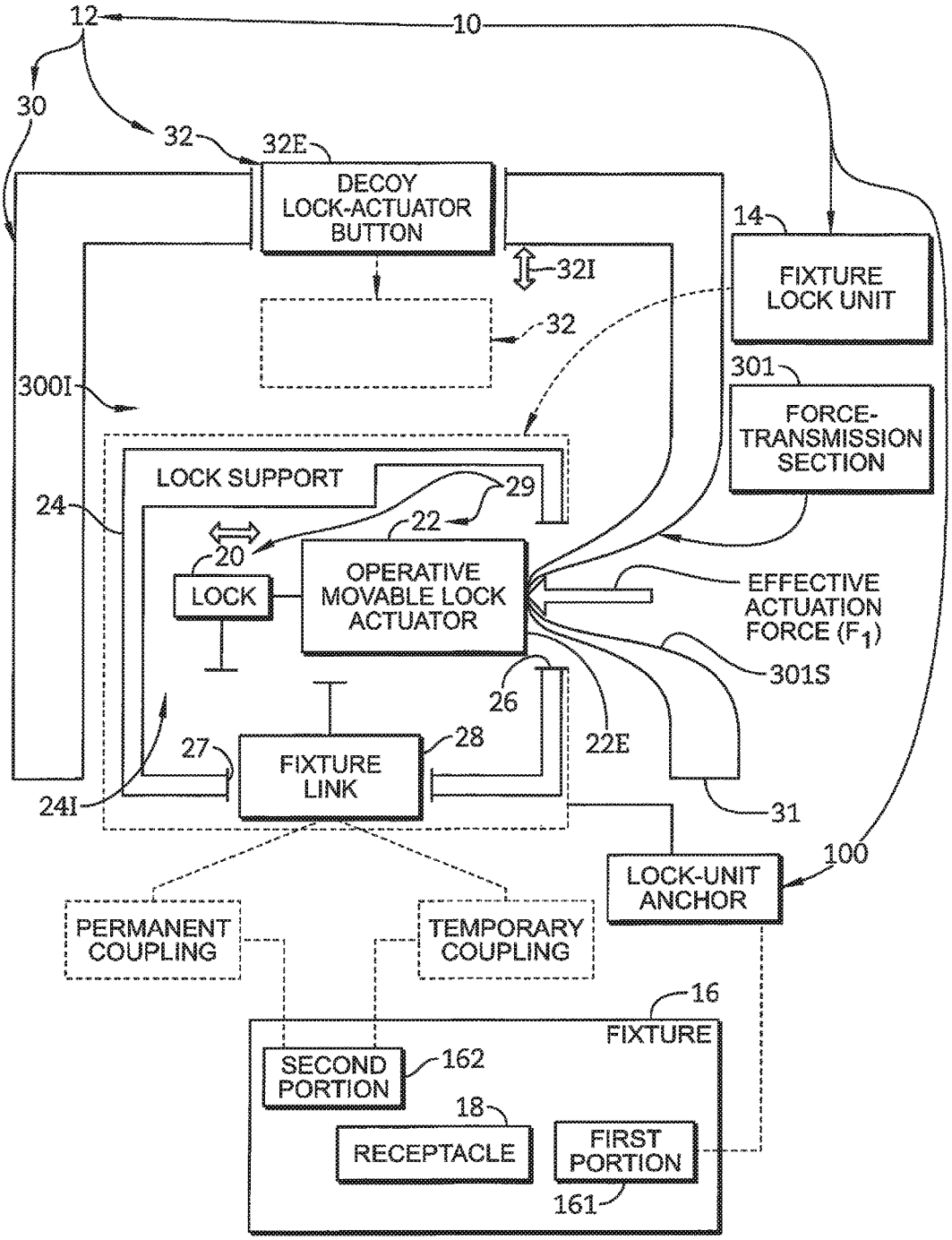
FIG. 4 is a view similar to FIGS. 2 and 3 showing that a knowing caregiver has caused the concealed operative movable lock actuator to move relative to the lock support to actuate the lock to free the fixture link to be moved relative to the lock support and the surrounding lock-actuator mask by applying an external effective actuator force to a pliable and deformable force-transmission section in a side wall of the lock-actuator mask to cause movement of the concealed operative movable lock actuator to unlock the fixture lock unit.

Fixture lock unit 14 includes a lock support 24 formed to include an interior region 24I, a lock 20 movable in interior region 24I of lock support 20 and adapted to communicate with fixture 16 via a fixture link 28, and an operative movable lock actuator 22 mounted for movement relative to lock support 24 to actuate lock 20 and unlock fixture lock unit 14 as suggested in FIGS. 1 and 4. In illustrative embodiments, lock-actuator mask 30 is sized and shaped to cover lock support 24 so that any exposed or visible portions of the operative movable lock actuator 22 of fixture lock unit 14 are concealed from view as suggested in FIGS. 1-4. Lock support 24 is formed to include an actuator-receiving aperture 26 and the operative movable lock actuator 22 is arranged to extend through and move in aperture 26 during movement of the operative movable lock activator 22 relative to lock support 24 as suggested in FIGS. 2-4.

Fixture lock unit 14 is associated with a fixture 16 having a receptacle 18 to block access by children to the receptacle 18 formed in the fixture 16 as suggested diagrammatically in FIGS. 1-4. In illustrative embodiments, the fixture lock unit 14 includes a lock 20 adapted to associate with a first portion 161 of the fixture 16 via a fixture link 28 as suggested diagrammatically in FIGS. 2-4 and an operative movable lock actuator 22 coupled to the lock 20 and mounted for movement by a caregiver to actuate lock 20 and thereby unlock fixture lock unit 14. In some illustrative embodiments, the fixture is a cabinet having (1) a drawer movable relative to a base to cover a receptacle formed in the drawer as suggested in FIGS. 9A-9D or (2) movable side-by-side doors covering an opening into the receptacle as suggested in FIGS. 11-13.

In illustrative embodiments, a child-resistant, access-control unit 12 in accordance with the present disclosure is mounted on a fixture lock unit 14 to conceal the operative movable lock actuator 22 and provide a non-operative visible DECOY lock-actuator button 32 that is movable between a normal projected position and a temporary depressed position and is elastically-biased or spring-biased as suggested by icon 321 as suggested diagrammatically in FIGS. 1-4. Unknowing children can see and push the elastically-biased (or spring-biased) visible and movable non-operative DECOY lock-actuator button 32 repeatedly without moving the underlying concealed operative movable lock actuator 22 to actuate lock 20 and unlock fixture lock unit 14 as suggested diagrammatically in FIGS. 2 and 3. Knowing caregivers can push inwardly on an exterior surface 301 of the child-resistant, access-control unit 12 to cause the underlying operative movable lock actuator 22 to move to actuate lock 20 and thereby unlock fixture lock unit 14 because they have been taught where to push as suggested in FIG. 4.

In illustrative embodiments, child-resistant, access-control unit 12 includes a lock-actuator mask 30 covering a portion of fixture lock unit 14 and a non-operative DECOY lock-actuator button 32 mounted in an unconcealed visible location on lock-actuator mask 30 for relative movement to a top wall in lock-actuator mask 30 as suggested diagrammatically in FIG. 1. Movement of the visible DECOY lock-actuator button 32 relative to lock-actuator mask 30 by an unknowing child or other person does not cause the concealed operative movable lock actuator 22 to move to actuate lock 20 and unlock fixture lock unit 14 as suggested in FIGS. 2 and 3.

In illustrative embodiments, a force-transmission section 301 of lock-actuator mask 30 is positioned to lie adjacent to the concealed operative movable latch actuator 22 and is made of a deformable elastic material as suggested diagrammatically in FIGS. 2-4. A symbol 301S may be provided on an exterior surface of lock-actuator mask 30 in accordance with the present disclosure to inform a caregiver of the location of the concealed operative movable latch actuator 22 under the force-transmission section 301 of lock-actuator mask 30 as suggested diagrammatically in FIGS. 2-4 and illustratively in FIG. 5. An external pushing force $F_1$ applied by a knowing caregiver to the force-transmission section 301 causes that section 301 to deform elastically and apply a motion-inducing force to the concealed operative movable lock actuator 22 that is sufficient to move the lock actuator 22 to actuate lock 20 and thereby unlock fixture lock unit 14 as suggested diagrammatically in FIG. 4. In illustrative embodiments, the entire outer shell 300 of lock-actuator mask 30 is made of the deformable elastic material.

A child-resistant, access-control unit 12 is adapted to be mounted on an existing fixture lock unit 14 operable to block access to a receptacle 18 in a fixture 16 as suggested in FIGS. 1-4. Access-control unit 12 includes a lock-actuator mask 30 configured to provide means for covering a portion of a fixture lock unit 14 associated with a fixture 16 having a receptacle 18 and formed to include a lock 20 and a movable lock actuator 22 coupled to the lock 20 to conceal the movable lock actuator 22 from an unknowing child that is observing the fixture 16 without blocking movement of the movable lock actuator 22 relative to the fixture 16 associated with the fixture lock unit 14 lock 20 and unlock fixture lock unit 14 and for transmitting an external effective actuation force $F_1$ applied to an exterior surface of the lock-actuator mask 30 by a knowing caregiver to the concealed movable lock actuator 22 to cause the concealed movable lock actuator 22 to move relative to the fixture 16 to actuate lock 20 and thereby unlock fixture lock unit 14 as suggested in FIGS. 1-4. Access-control unit 12 also includes an elastically-biased or spring-biased DECOY lock-actuator button 32 mounted in a visible location on the lock-actuator mask 30 for movement relative to the lock-actuator mask 30 from a normal projected (i.e. undepressed) position suggested in FIG. 2 to a temporary depressed position suggested in FIG. 3 without causing movement of the concealed movable lock actuator 32 relative to the fixture 16 to actuate lock 20 and unlock fixture lock unit 14 when a false activation force $F_2$ is applied to DECOY lock-actuator button 32. Therefore, the concealed movable lock actuator 22 will not move to actuate and unlock the lock 20 in response to movement of the DECOY lock-actuator button 32 from the normal projected position to the temporary depressed position.

Lock-actuator mask 30 includes an outer shell 300 formed to include an interior region 3001 sized to receive lock 20 and concealed movable lock actuator 22 therein as suggested in FIG. 1H. Outer shell 300 is formed to include a button-receiving aperture 34 opening into interior region 3001 of outer shell 300 as suggested in FIG. 1H. DECOY lock-actuator button 32 is mounted in a visible location for movement relative to the outer shell 300 relative to the button-receiving aperture 34 formed in outer shell 300 as suggested in FIGS. 1H and 1I.

A force-transmission section 301 of outer shell 300 is arranged to lie in confronting relation to a free outer end 22E of a concealed operative movable lock actuator 22 stored in interior region 3001 of outer shell 300 and mounted for movement in an aperture 26 formed in lock support 24 as suggested in FIGS. 2-4. The force-transmission section 301 is made of a deformable elastic material to cause the force-transmission section 301 to deform elastically in response to application of an external force by a knowing caregiver to an exterior surface of the force-transmission section 301 to move the force-transmission section 301 relative to the DECOY lock-actuator button 32 to engage and move the concealed operative movable lock actuator 22 of the fixture lock unit 14 relative to the outer shell 300 and the lock support 24 from an unactuated position suggested in FIGS. 2 and 3 allowing the lock 20 to remain locked to an actuated position suggested in FIG. 4 actuating lock 20 and thereby unlocking the fixture lock unit 14.

Lock-actuator mask 30 further includes a symbol 301S provided on an exterior surface of outer shell 300 that is recognizable by the knowing caregiver to identify the location of a concealed operative movable lock actuator 32 of fixture lock unit 14 stored inside interior region 3001 of outer shell 300. In illustrative embodiments, the symbol 301S is provided on force-transmission section 301 of lock-actuator mask 30 so that the knowing caregiver can apply an external effective actuation force $F_1$ to a portion of outer shell 300 lying in confronting relation to the concealed operative movable lock actuator 22 to deform outer shell 300 and move a portion of outer shell 300 relative to non-operative DECOY lock-actuator button 32 to engage and move the concealed operative movable lock actuator 22 of fixture lock unit 14 relative to outer shell 300 from an unactuated position suggested in FIGS. 2 and 3 allowing the lock 20 to remain locked to an actuated position suggested in FIG. 4 actuating lock 20 and thereby unlocking fixture lock unit 14.

Lock-actuator mask 30 is made of a pliable elastic plastics material and may be formed to include a button-receiving aperture or space 34. DECOY lock-actuator button 32 is mounted for movement in or relative to the button-receiving aperture or space 34 between the normal projected position suggested in FIGS. 2 and 4 and the temporary depressed position suggested in FIG. 3 without contacting or otherwise causing movement of the concealed movable lock actuator 22. The pliable elastic plastics material is translucent in some illustrative embodiments as suggested in FIG. 6.

Fixture security system 10 includes a child-resistant, access-control unit 12 in accordance with the present disclosure coupled to a fixture lock unit 14 associated with a fixture 16 having a receptacle 18 as suggested in FIG. 1. Fixture lock unit 14 includes a lock 20 associated with fixture 16 via fixture link 28 and also includes an operative movable lock actuator 22. Child-resistant, access-control unit 12 includes a lock-actuator mask 30 mounted on fixture lock unit 14 to conceal the operative movable lock actuator 22 of fixture lock unit 14 and a visible non-operative DECOY lock-actuator button 32 mounted in an unconcealed visible location on lock-actuator mask 30 for movement relative to lock-actuator mask 30 when pushed by an unknowing child or other person without causing movement of the concealed operative movable lock actuator 22 of fixture lock unit 14 to actuate lock 20 and thereby unlock fixture lock unit 14.

Fixture 16 is formed to include a receptacle 18 as shown diagrammatically in FIG. 2. Fixture security system 10 is associated with fixture 16 and is used to block access by unauthorized persons to the receptacle 18 associated with fixture 16 as also suggested in FIG. 2.

Fixture lock unit 14 of fixture security system 10 includes a lock support 24 formed to include an actuator aperture 26 and, in illustrative embodiments, an inner link-receiver inlet 27 as shown, for example, in FIG. 2. Fixture lock unit 14 also includes a fixture link 28 and a link anchor 29 as suggested in FIG. 2.

Fixture link 28 is adapted to mate permanently or temporarily with a second portion 162 of fixture 16 to block access to the receptacle 18 formed in fixture 16 and arranged to extend through the inner-link receiver inlet 27 into an interior region 24I formed in lock support 24. Fixture link 28 can have any suitable structure and is arranged to pass out of the interior region 3001 formed in outer shell 300 of lock-actuator mask 30 through an outer-link receiver inlet 31 formed in outer shell 300 of lock-actuator mask 30 as suggested in FIG. 2. Fixture link 28 functions in any suitable manner to interconnect lock 20 with a second portion 162 of fixture 16 or a structure mounted on or coupled to the fixture 16.

Link anchor 29 comprises an operative movable lock actuator 22 mounted for movement in the actuator aperture 26 formed in the lock support 24 under the control of a knowing caregiver as suggested in FIG. 4 and a lock 20 coupled to the operative movable lock actuator 22 for movement therewith as suggested in FIGS. 3 and 4. Lock 20 is mated to fixture link 28 when fixture lock unit 14 is locked to provide means for blocking access to the receptacle 18 formed in the fixture 16 as suggested diagrammatically in FIGS. 2 and 3.

Access-control unit 12 of fixture security system 10 includes a lock-actuator mask 30 arranged to surround lock support 24 to conceal the operative movable lock actuator 22 of fixture lock unit 14 from view and a non-operative DECOY lock-actuator button 32 mounted in an unconcealed visible location for movement in a button-receiving aperture 34 formed in lock-actuator mask 30 without causing any movement of the operative movable lock actuator 22 to actuate lock 20 and thereby unlock fixture lock unit 14. Lock support 14 is also formed to include an inner-link receiver inlet 27 through which fixture link 28 extends and moves relative to lock-actuator mask 30 and fixture 16 as suggested in FIGS. 2-4.

An unknowing child has moved the non-operative DECOY latch actuator button 32 relative to the lock-actuator mask 30 as suggested in FIG. 3 without causing movement of the concealed operative movable lock actuator 22 to actuate lock 20 associated with fixture link 28 and unlock fixture lock unit 14. In contrast, a knowing caregiver has caused the concealed operative movable lock actuator 20 to move relative to lock support 24 to actuate lock 20 to free fixture link 28 to be moved relative to lock support 24 and the surrounding lock-actuator mask 30 as suggested in FIG. 4 by applying an external effective actuator force $F_1$ to a pliable and deformable force-transmission section 301 in a side wall of lock-actuator mask 30 to cause movement of the concealed operative movable lock actuator 22 to actuate lock 20 and thereby unlock fixture lock unit 14.

Figure 5:
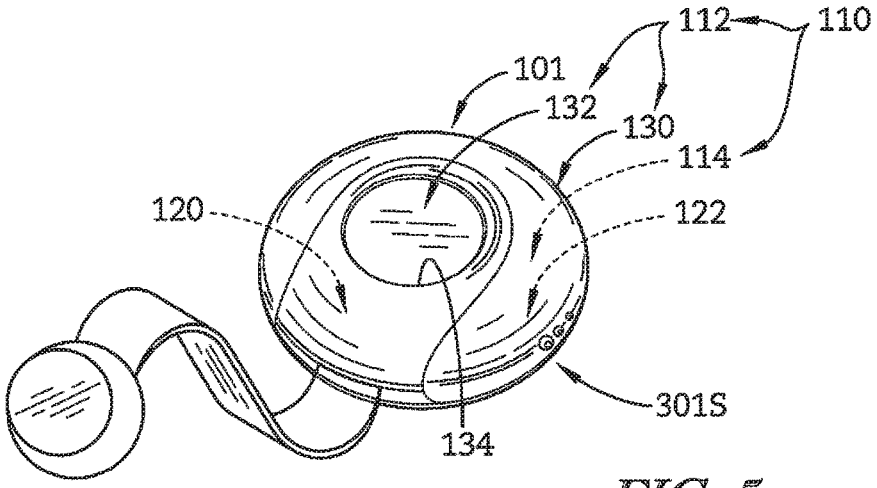
FIGS. 5-8 show a first fixture security system embodied by an all-purpose strap lock having a fixture lock unit covered by a child-resistant, access-control unit made in accordance with the present disclosure to include a lock-actuator mask and a visible DECOY lock-actuator button mounted for movement in a central aperture formed in the lock-actuator mask.
Figure 6:
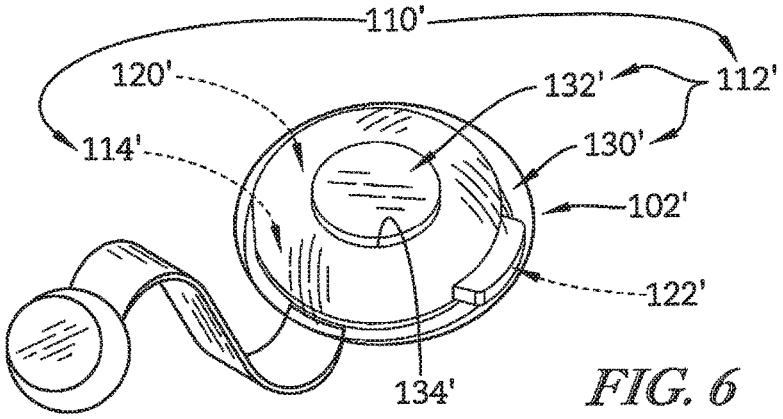
Figure 7:
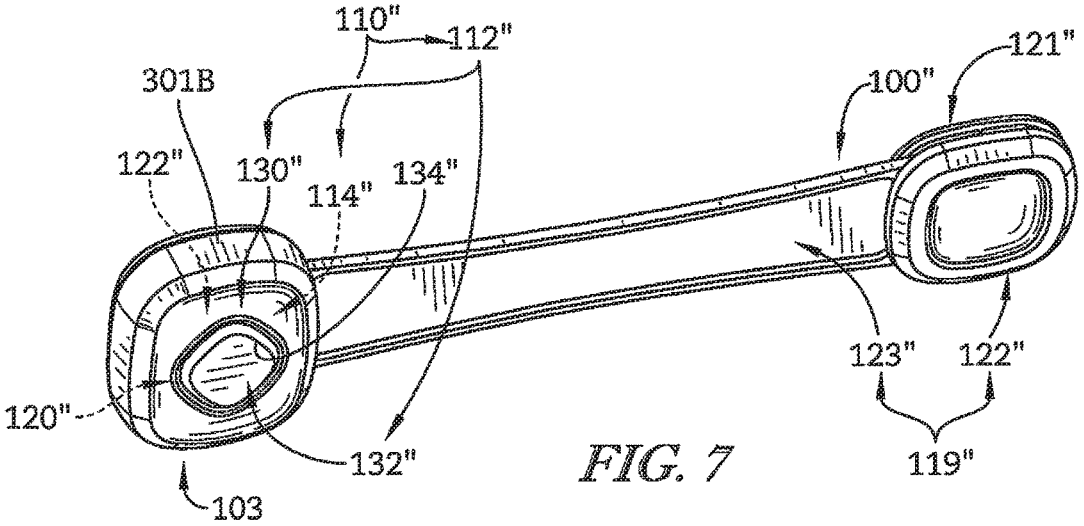

An illustrative first fixture security system is expressed in three versions 110, 110', and 110" as shown in FIGS. 5, 6, and 7-8. First fixture security system 110 is embodied by an illustrative first all-purpose strap lock 101 that is shown in FIG. 5 as having a fixture lock unit 114 covered by a child-resistant, access-control unit 112 made in accordance with the present disclosure to include a lock-actuator mask 130 and a visible non-operative DECOY lock-actuator button 132 mounted for movement, for example, in a central aperture 134 formed in lock-actuator mask 30. First all-purpose strap lock 101 is shown in FIG. 5 to include a lock-actuator mask 130 made of an opaque material and formed to include a symbol 301S (e.g., three raised bumps) to identify the location of the concealed operative movable lock actuator 22 that is located under the opaque lock-actuator mask 30. Second fixture security system 110' is embodied by an illustrative second all-purpose strap lock 102 is shown in FIG. 6 to include a visible non-operative DECOY lock-actuator button 132' mounted for movement in or relative to a central aperture 134' formed in a lock-actuator mask 130' made of a translucent material and arranged to cover the underlying concealed operative movable lock actuator 122 for associated lock 120. Third fixture security system 110" is embodied by an illustrative third all-purpose strap lock 103 is shown in FIG. 7 (and in more illustrative detail in FIGS. 7A-7C) to include a visible non-operative DECOY lock-actuator button 132" mounted for movement in or relative to a central aperture 134" formed in a lock-actuator mask 130" made of an opaque material. Non-operative DECOY lock-actuators 132, 132', 132" can take any of the forms disclosed herein and in accordance with the present disclosure. Strap locks 101, 102, 103 embodying a first fixture security system can be used to prevent access to receptacles formed in entertainment centers, refrigerators, cabinets, microwaves, freezers, dryers, and dishwashers or other fixtures.

Figure 7A:
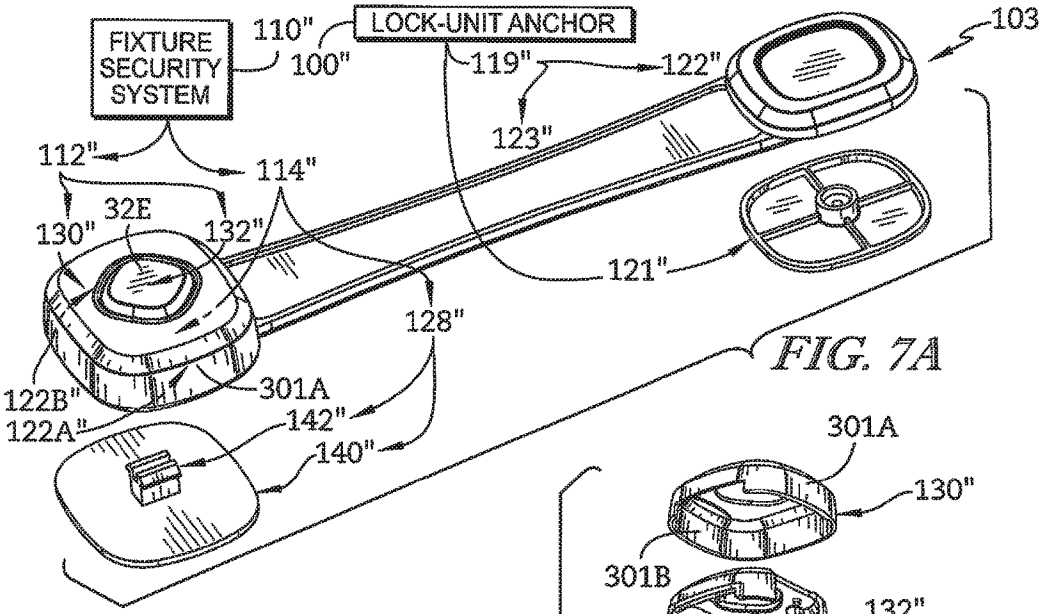
FIG. 7A is an exploded perspective assembly view of the all-purpose strap lock of FIG. 7 showing that the strap lock comprises a fixture lock unit, a fixture link below the fixture lock unit, a child-resistant, access-control unit above the fixture lock unit, and a lock-unit anchor including a strap coupled to a right side of the fixture lock unit and a strap anchor coupled to a right end of the strap and adapted to be mated to a first portion of the fixture, and showing that: (1) the fixture link includes a retainer-support plate adapted to be mounted permanently on a second portion of the fixture such as a cabinet and an upstanding lock retainer configured to engage the lock included in the lock fixture unit, (2) the lock fixture unit includes a lock support, a lock contained in the lock support, and a first concealed operative movable lock actuator coupled to the lock, and (3) the child-resistant, access-control unit includes a lock-actuator mask and a visible and movable non-operative DECOY lock-actuator button mounted for movement relative to the lock-actuator mask.
Figure 7B:
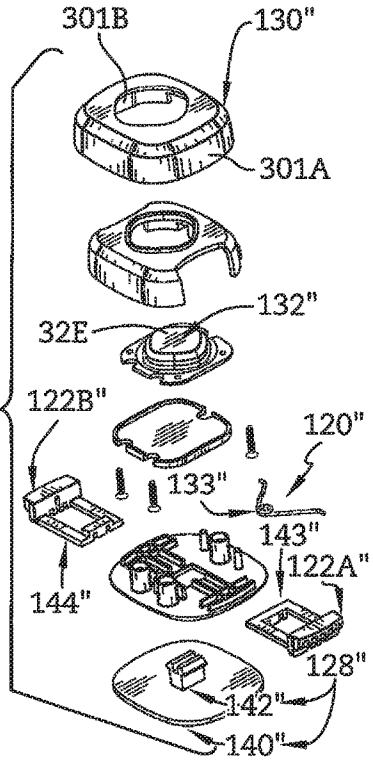
FIG. 7B is an exploded perspective view of the lock fixture unit showing that the lock comprises first and second link anchors, an anchor-biasing spring for biasing the first and second link anchors normally to engage the upstanding lock retainer when the lock fixture unit is mated to the fixture link, a first operative movable lock actuator associated with the first link anchor, and a second operative movable lock actuator associated with the second link anchor.
Figure 7C:
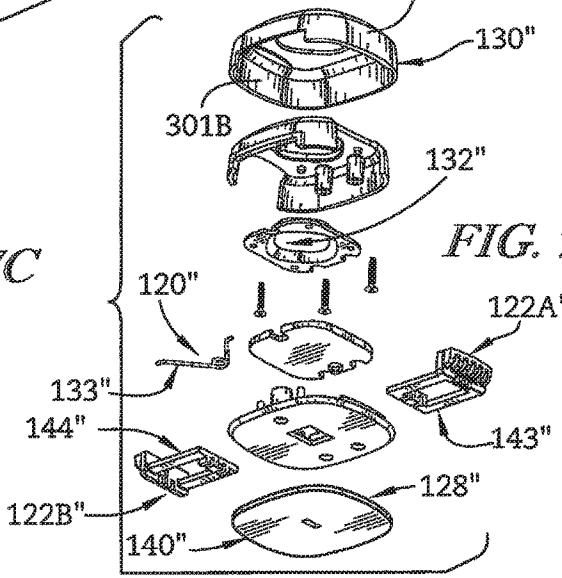
FIG. 7C is a view similar to FIG. 7B taken from a different point of view and including the fixture link of FIG. 7A.

An exploded perspective assembly view of the illustrative third all-purpose strap lock 103 is provided in FIG. 7A. Strap lock 103 provides a fixture security system 110" comprises a fixture lock unit 114", a fixture link 128" below fixture lock unit 114", a child-resistant, access-control unit 112" above fixture lock unit 114", and a lock-unit anchor 100" as suggested in FIG. 7A. Lock-unit anchor 100" includes a strap 119" coupled to a right side of fixture lock unit 114" and a strap anchor 121" coupled to a right end of strap 120" and adapted to be mated to a first portion 161 of a fixture 16. Strap 119" comprises a strip support 122" adapted to mate with strap anchor 121" and a flexible strip 123" arranged to interconnect strip support 122" and fixture lock unit 114". Child-resistant, access-control unit 112" comprises lock-actuator mask 130" and a non-operative DECOY lock-actuator button 132".

Fixture link 128" includes a retainer-support plate 140" adapted to be mounted permanently or temporarily on a second portion 162 of a fixture 16 as suggested in FIG. 1. Fixture link 128" also includes an upstanding anchor retainer 142" coupled to an upwardly facing surface of retainer-support plate 140" and arranged to mate with first and second latches 143", 144" included in lock 120". Lock 120" also includes latch-biasing spring 133".

Figure 7D:
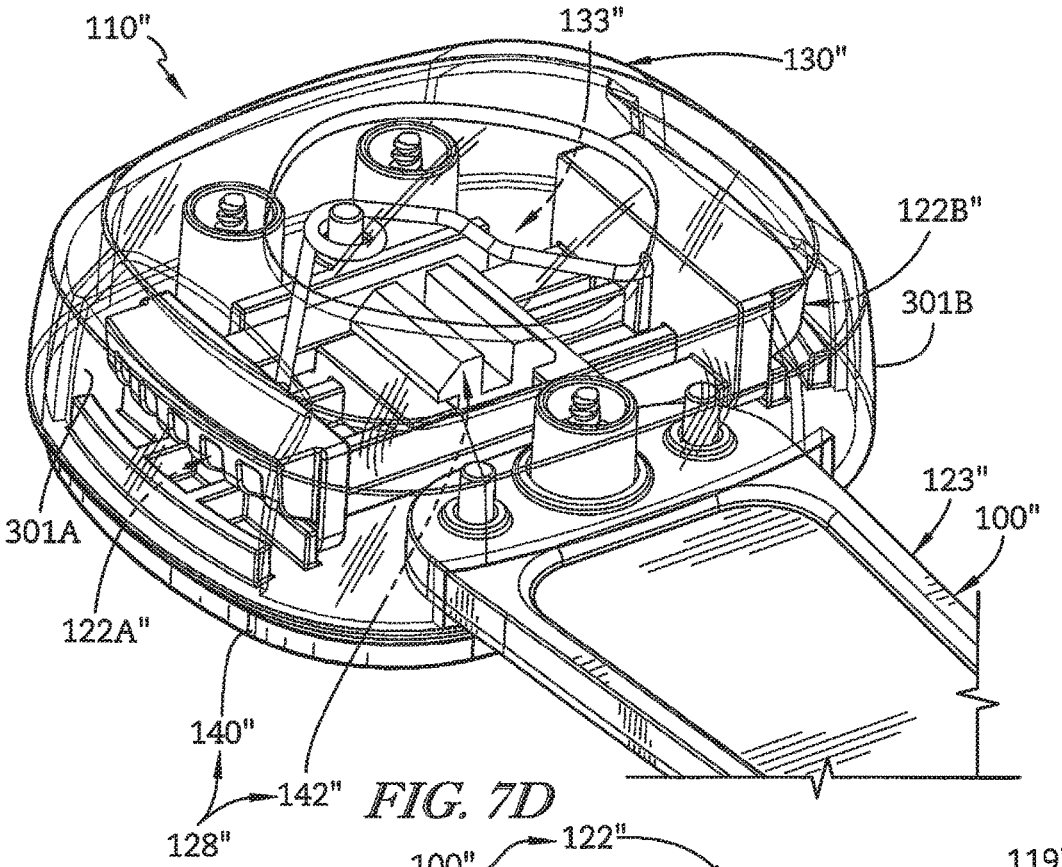
FIG. 7D is an enlarged view of the fixture lock unit shown in FIG. 7A without showing the non-operative DECOY lock-actuator button.

One operative movable lock actuator 122A" is coupled to first latch 143" to move therewith and first latch 143" is configured to mate with upstanding anchor retainer 142" to establish a first portion of lock 120" as suggested in FIG. 7D. Another operative movable lock actuator 122B" is coupled to second latch 144" to move therewith and second latch 144" is configured to mate with upstanding anchor retainer 142" to establish a second portion of lock 120" as suggested in FIG. 7D.

Figure 8:
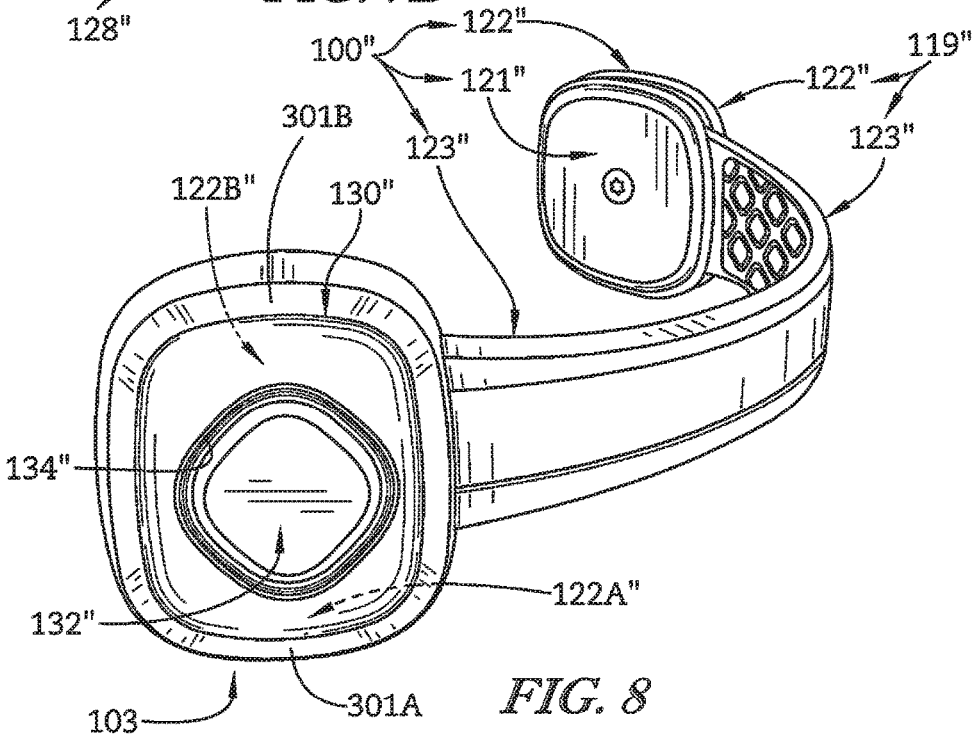
Figure 9A:
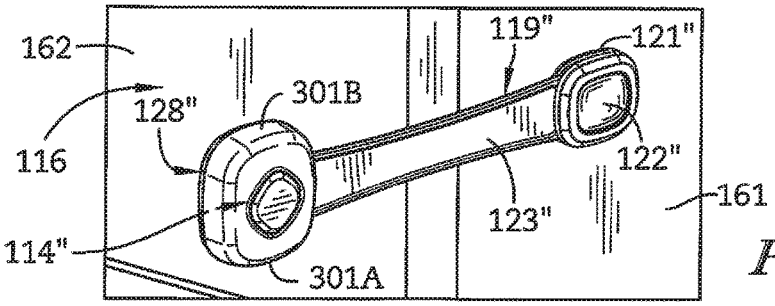
FIGS. 9A-9D show multi-step operation of a fixture lock unit of the type included in the all-purpose strap lock of FIGS. 7 and 8.
Figure 9B:
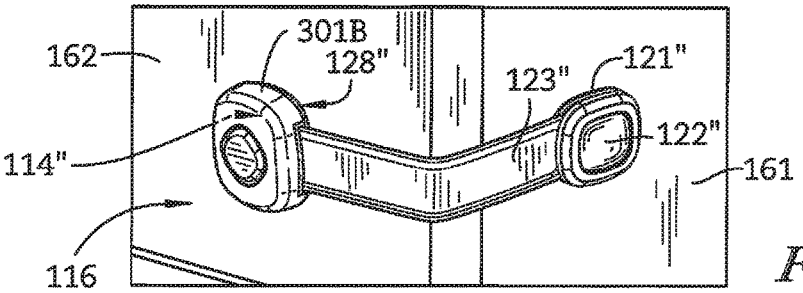
Figure 9C:
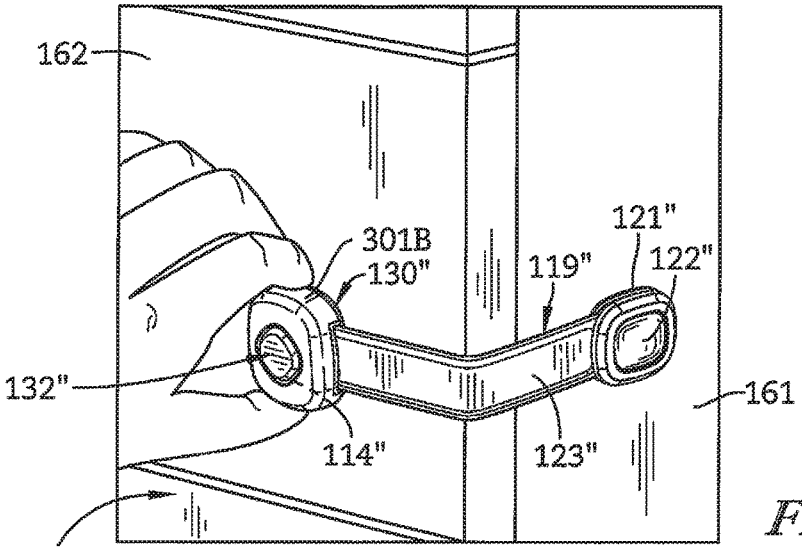
Figure 9D:
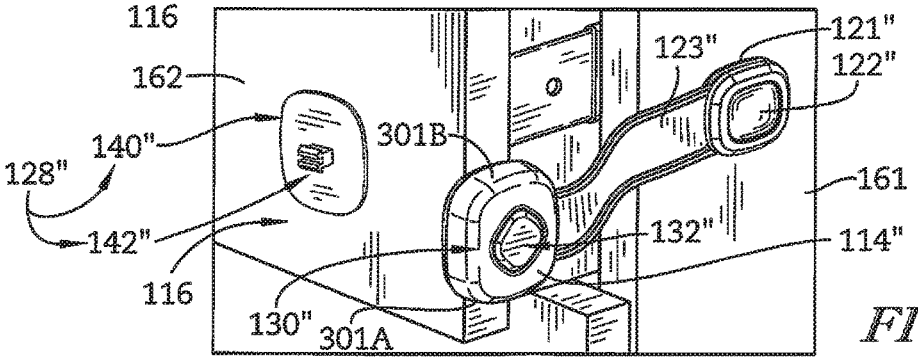

Multi-step mounting of a fixture lock unit 114" of the type included in the all-purpose strap lock 103 of FIGS. 7 and 8 on a cabinet 116 without showing a child-resistant, access-control unit 112" made in accordance with the present disclosure mounted on that fixture lock unit 114" is shown in FIGS. 9A-9D. A caregiver adheres a lock-unit anchor to a static face of a cabinet as shown in FIG. 9A. With the strap taut, the caregiver adheres a fixture link 28" to a door of a cabinet as shown in FIG. 9B. To lock, a caregiver presses the fixture lock unit 114" onto the fixture link 28" to cause the lock 120" to engage the fixture link 128". To unlock, a caregiver pushes inwardly on the operative movable lock actuator 122" that is concealed under the lock-actuator mask 30" as suggested in FIG. 9C and then lifts the fixture lock unit 114" off of the fixture link 28" as suggested in FIG. 9D.

Figure 10:
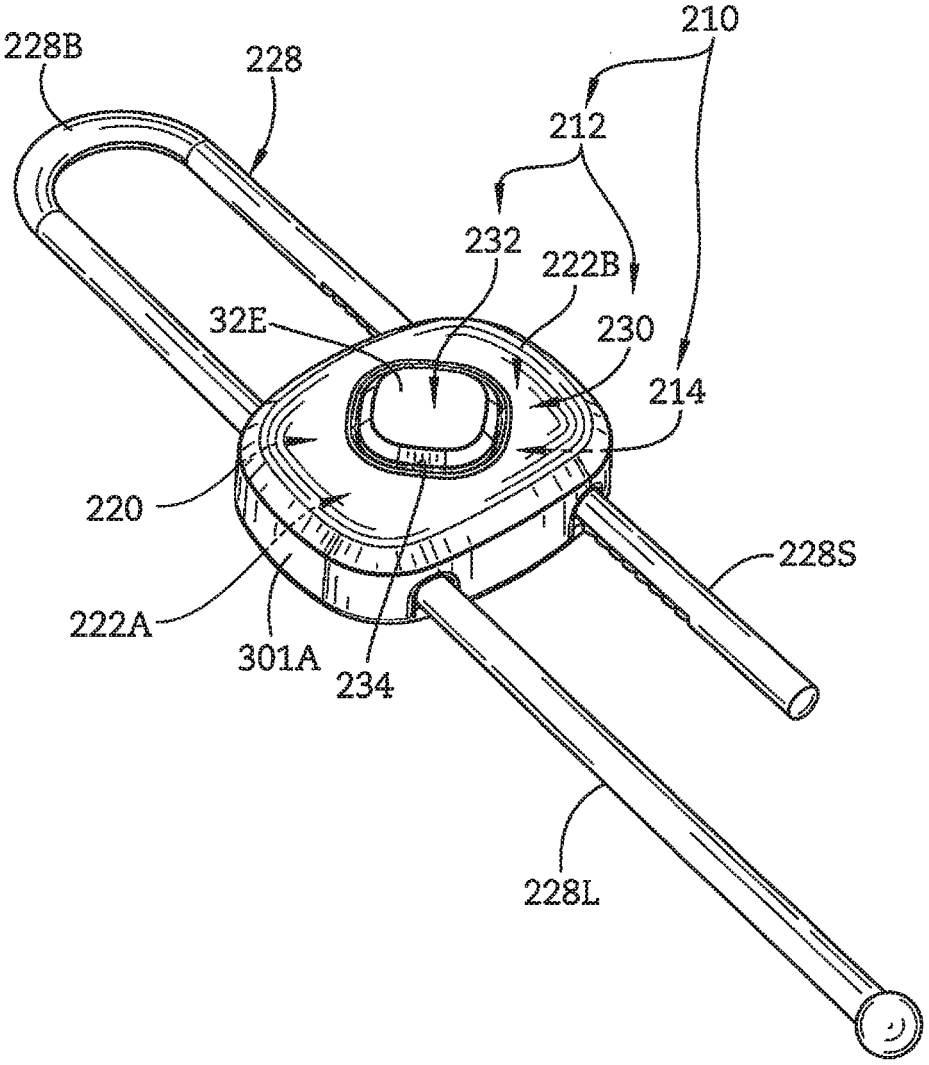
FIG. 10 shows a second fixture security system embodied by a dual handle slider lock having a fixture lock unit covered by a child-resistant, access-control unit made in accordance with the present disclosure to include a lock-actuator mask and a visible non-operative DECOY lock-actuator button mounted for movement relative to the lock-actuator mask.
Figure 10A:
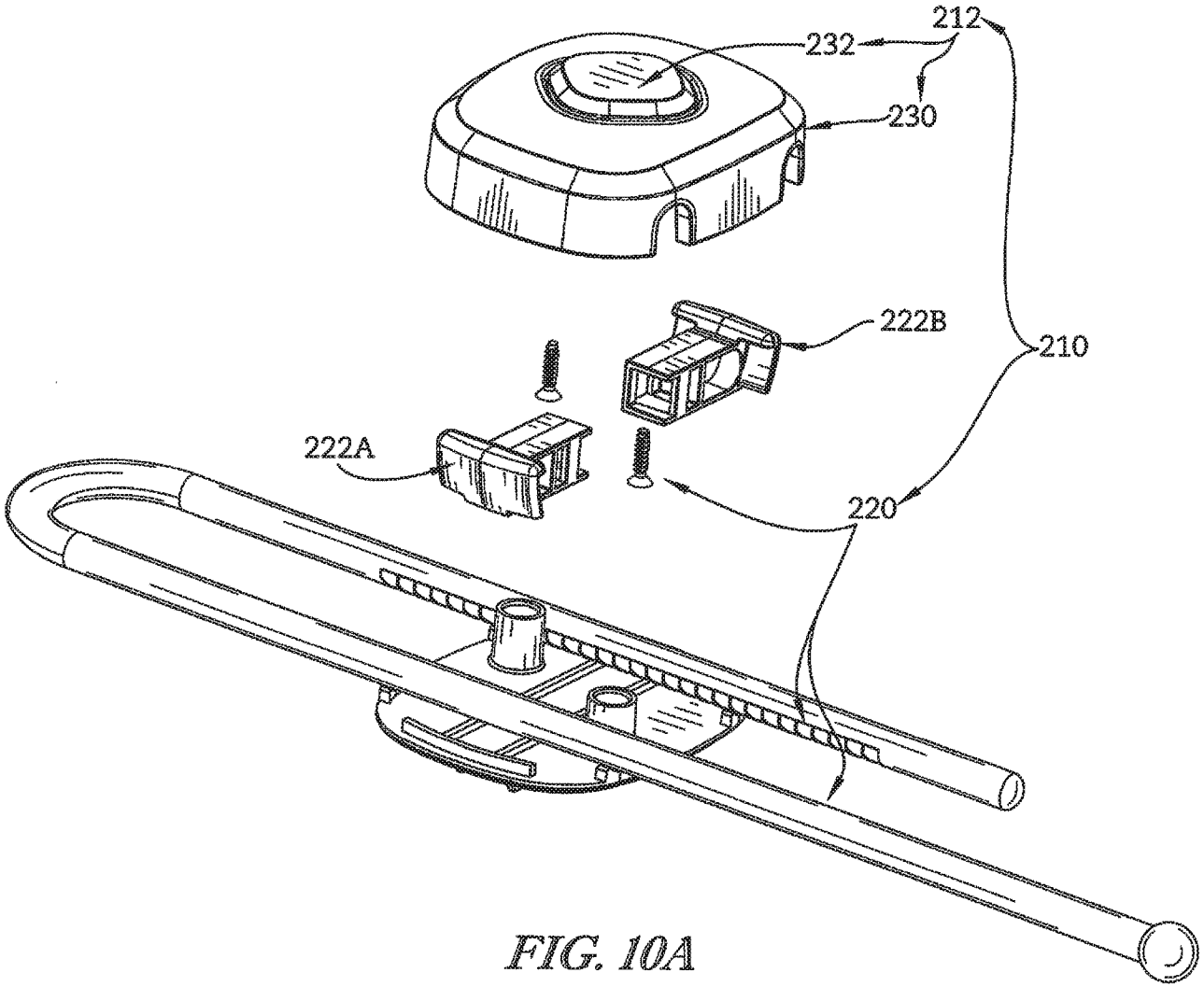
FIG. 10A is an exploded perspective assembly view of the components that cooperate to form the dual handle slider lock of FIG. 10.
Figure 10C:
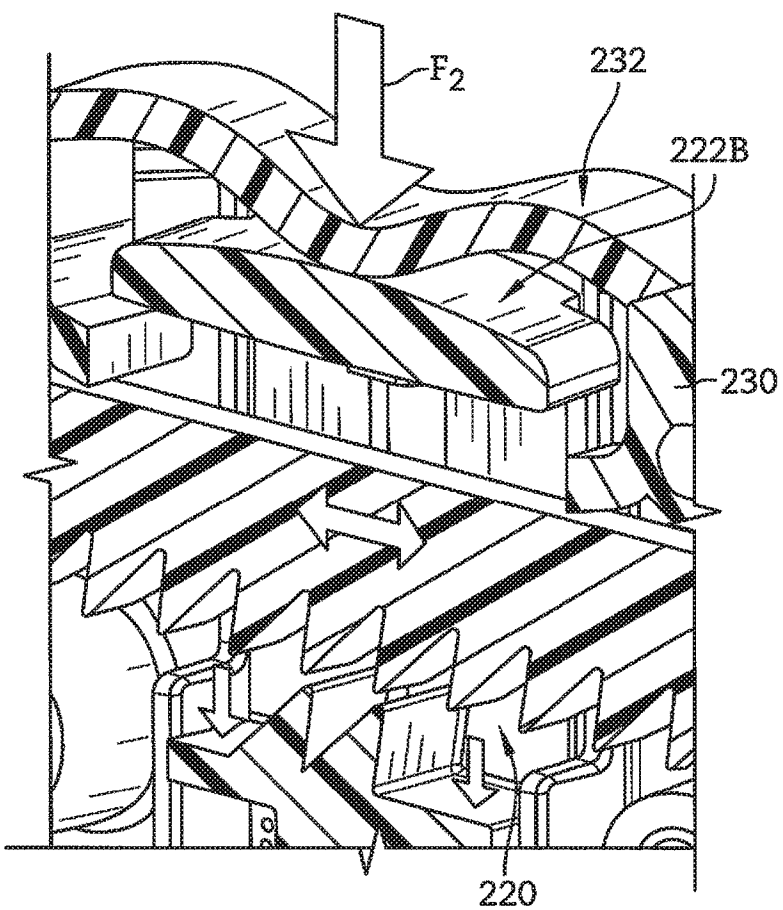
FIG. 10C is a view similar to FIG. 10B showing the non-operative DECOY lock-actuator button in the temporary depressed position.
Figure 10B:
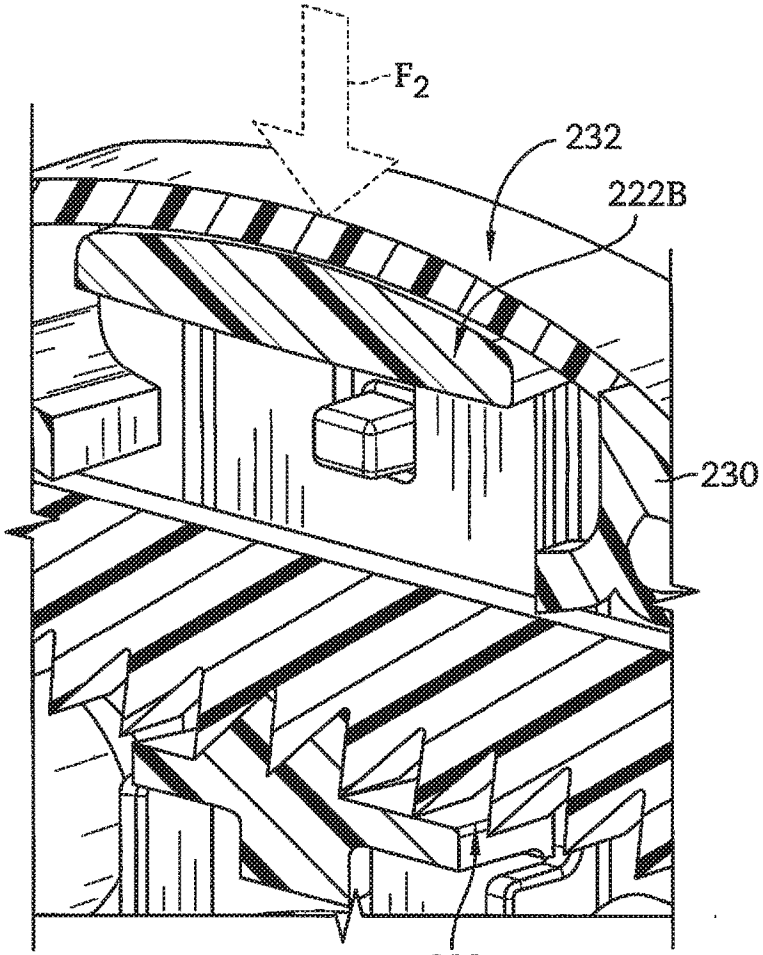
FIG. 10B is an enlarged partial sectional view taken along line 10B-10B of FIG. 10 showing the non-operative DECOY lock-actuator button in the normal projected position.

An illustrative second fixture security system 200 is shown in FIG. 10. Fixture security system 200 prevents access to cabinets with door knobs or handles that fairly close together when the doors carrying those knobs or handles are closed. Second fixture security system 200 is embodied by a dual handle slider lock having a fixture lock unit 214 covered by a child-resistant, access-control unit 212 made in accordance with the present disclosure to include a lock-actuator mask 230. Fixture lock unit 214 includes an operative movable lock actuator 222 that is concealed by lock-actuator mask 230.

Figure 11A:
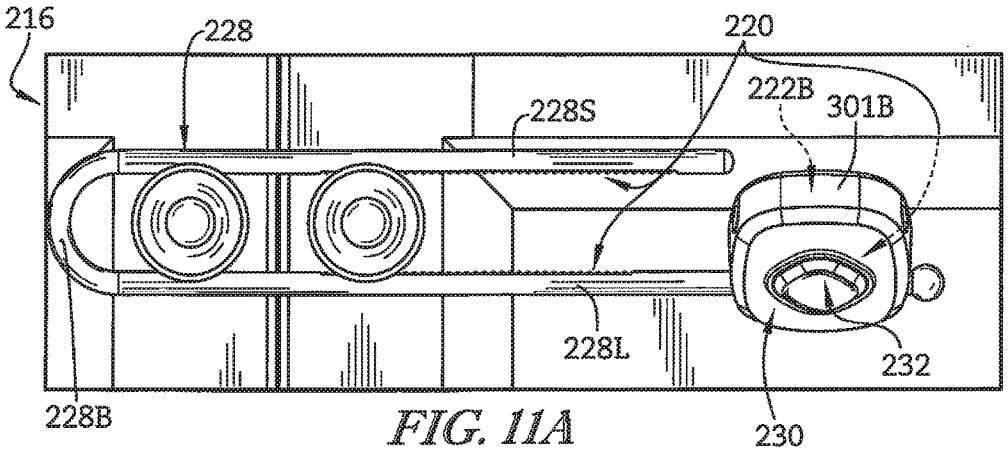
FIGS. 11A-11C show multi-step operation of a fixture lock unit of the type included in the dual handle slider lock of FIG. 10 on a cabinet.
Figure 11B:
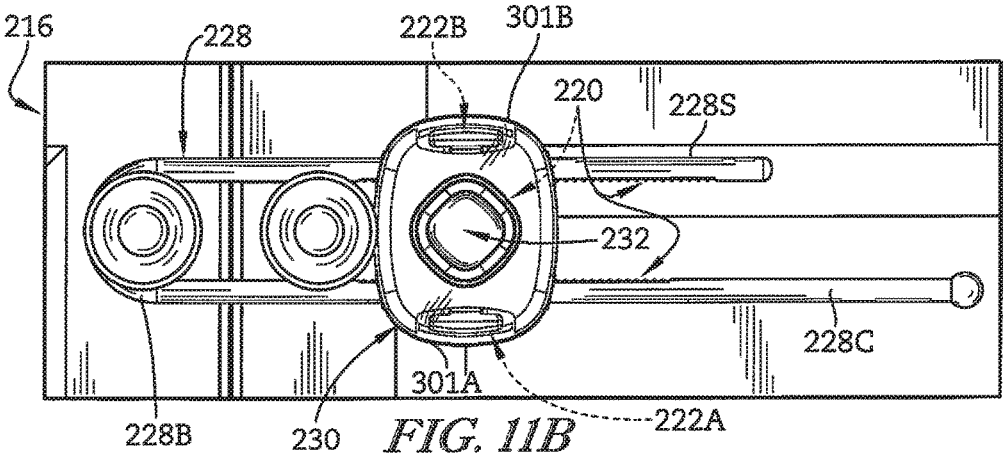
Figure 11C:
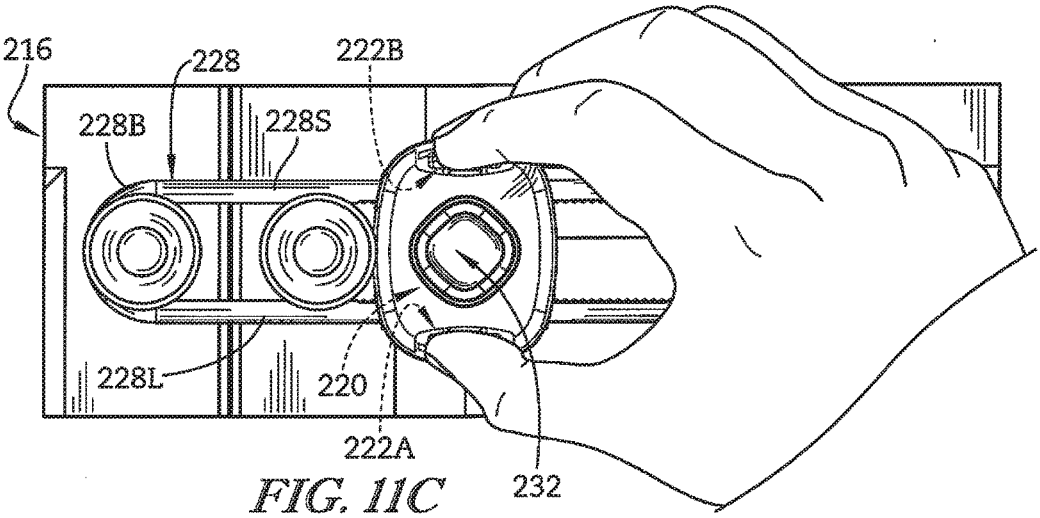

Multi-step mounting of a fixture lock unit of the type included in the dual handle slider lock of FIG. 10 on a cabinet 216 without showing a child-resistant, access-control unit 212 made in accordance with the present disclosure mounted on that fixture lock unit 214 is shown in FIG. 11. Fixture lock unit 214 includes two operative movable lock actuators 222 as shown in FIG. 11 and these actuators 222 are concealed as suggested in FIG. 10 when lock-actuator mask 230 of access-control unit 212 is mounted on a lock support of fixture lock unit 214. Fixture lock unit 214 also includes a fixture link 228 having a short rail 228S, a relatively longer rail 228L, and a curved bight 228B interconnecting the short and lock rails 228S and 228L.

As suggested in FIG. 11, to lock, the caregiver separates the lock support from the shorter rail 228S of the fixture link 228 as shown in FIG. 11A and then tightens the short and long rails 228S and 228L of the fixture link 228 as suggested in FIG. 11B. To unlock a caregiver pushes inwardly on the force-transmission sections 301A, 301B of lock-actuator mask 230 to move the operative movable lock actuators 222A, 222B to free the lock support to move relative to the short and long rails 228S and 228L of the fixture link 228.

Figure 12:
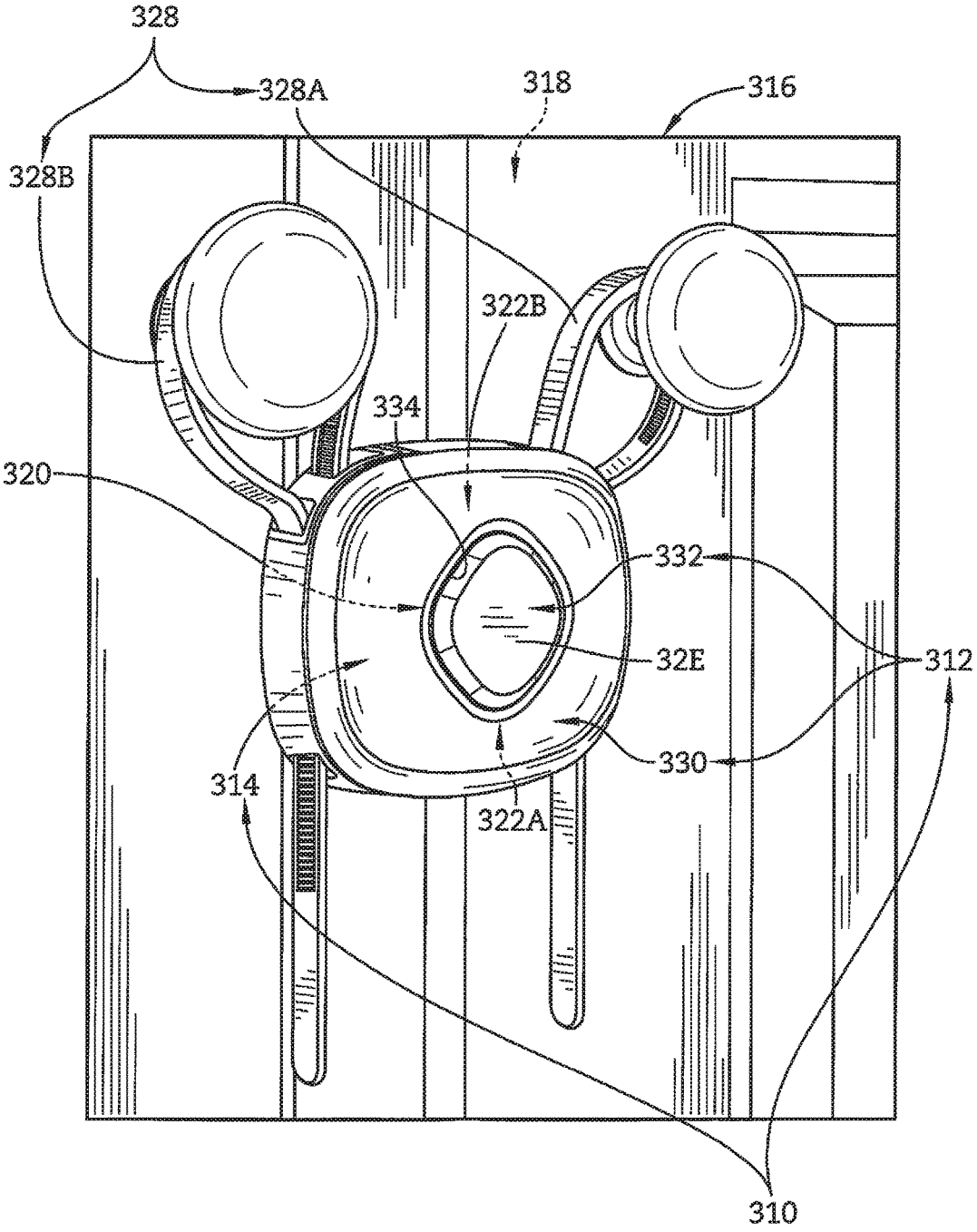
FIG. 12 shows a third fixture security system embodied by a dual handle lock having a fixture lock unit covered by a child-resistant, access-control unit made in accordance with the present disclosure to include a lock-actuator mask and a visible non-operative DECOY lock-actuator button mounted for movement relative to the lock-actuator mask.
Figure 13A:
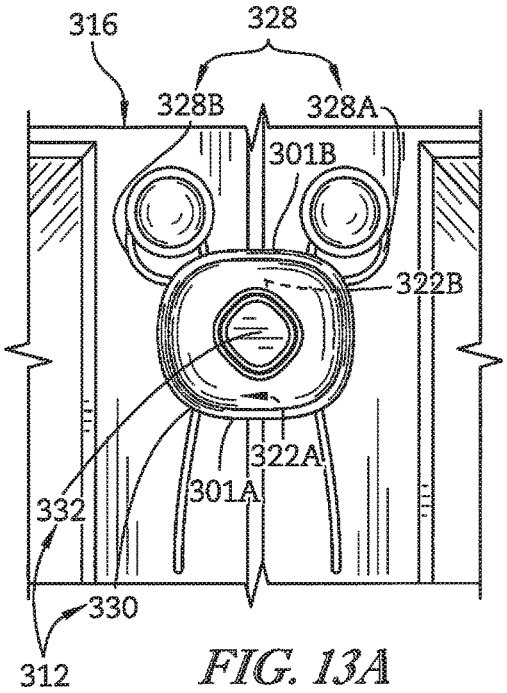
FIGS. 13A-13D show multi-step operation of a fixture lock unit of the type included in the dual handle lock of FIG. 12 on a cabinet.
Figure 13B:
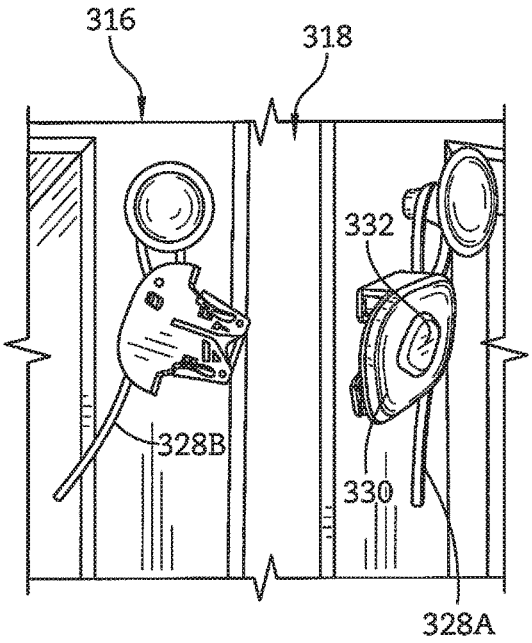
Figure 13C:
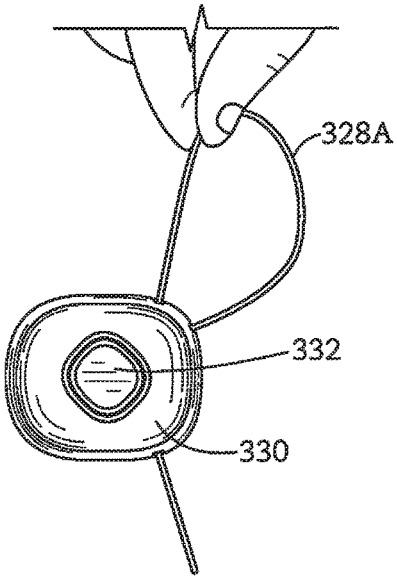
Figure 13D:
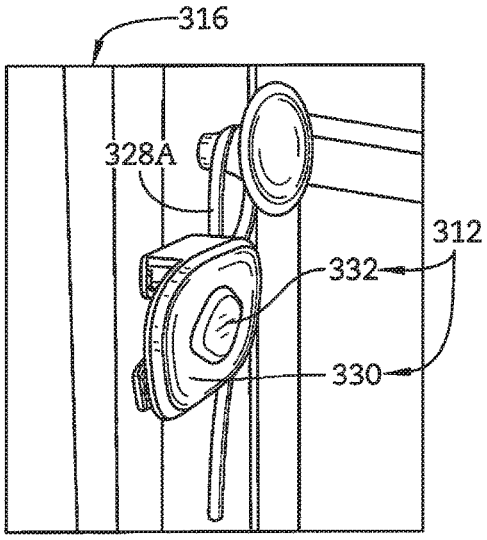
Figure 14A:
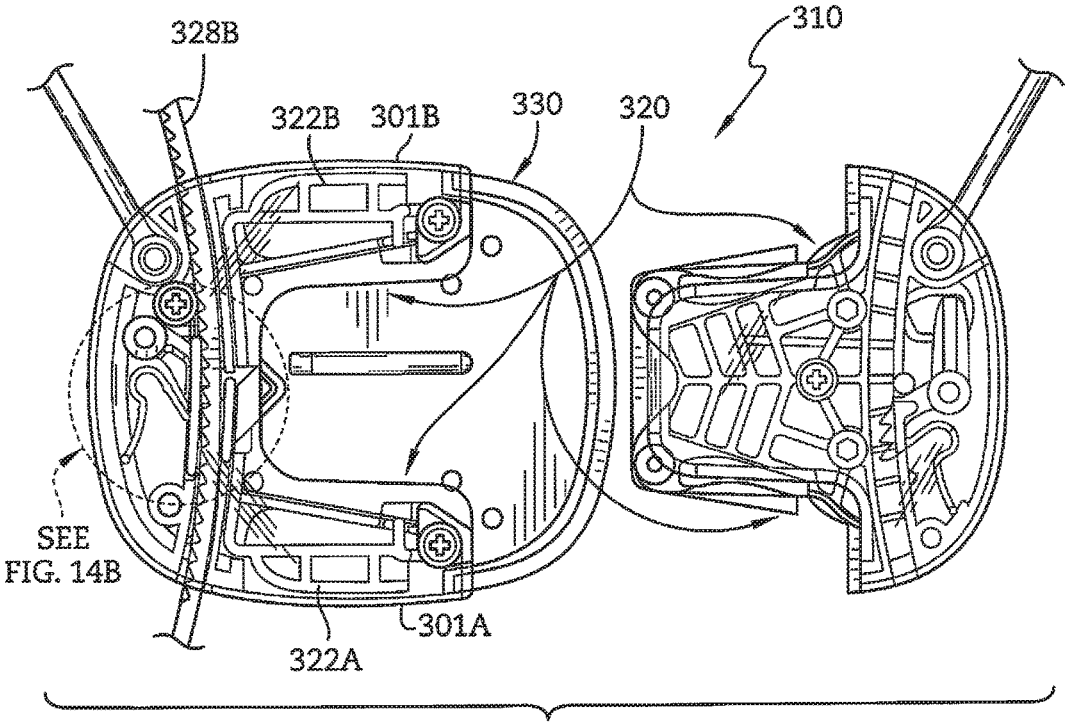
FIGS. 14A-14D show various views of the fixture lock unit of FIGS. 12 and 13A-13D.
Figure 14B:
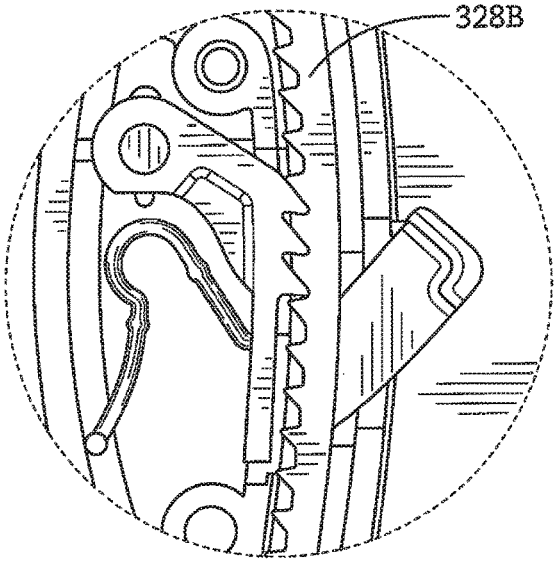
Figure 14C:
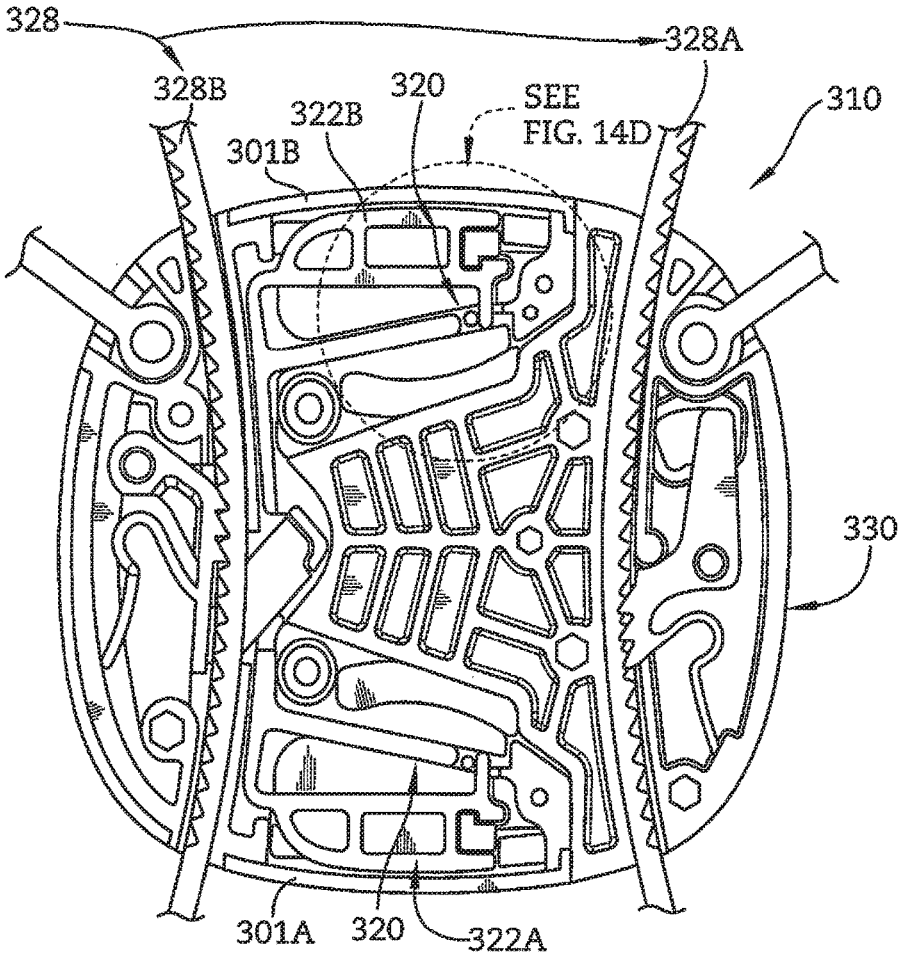
Figure 14D:
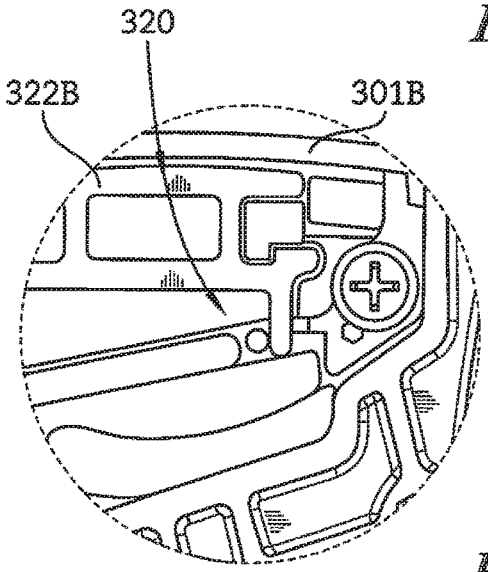

An illustrative third fixture security system 300 is shown in FIG. 12. Third fixture security system 300 is embodied by a dual handle lock having a fixture lock unit 314 covered by a child-resistant, access-control unit 312 made in accordance with the present disclosure to include a lock-actuator mask 330 and a visible DECOY lock-actuator button 332 mounted for movement in a central aperture 334 formed in lock-actuator mask 330. Multi-step mounting of a fixture lock unit 314 of the type included in the dual handle lock of FIG. 12 on a cabinet 316 formed to include a receptacle without showing a child-resistant, access-control unit 312 made in accordance with the present disclosure mounted on that fixture lock unit 314 is shown in FIG. 13 as illustrative features are shown in FIGS. 14A-14D.

Dual handle lock 310 also includes a fixture lock unit 314 comprising opposing operative movable lock actuators 322A, 322B as suggested in FIG. 12 and shown in FIGS. 14A-D. These actuators 322A, 322B are concealed as suggested in FIG. 12 when lock-actuator mask 330 of access-control unit 312 is mounted on a lock support of fixture lock unit 314. Fixture lock unit 314 also includes a fixture link 328 comprising separate loop strips 328A, 328B that are sized to mate with door knobs in fixture 316 as suggested in FIGS. 12 and 13A.

The invention claimed is:

1. A fixture security system comprising a fixture lock unit operable to block access to a receptacle in a fixture, the fixture lock unit including a lock and an operative movable lock actuator coupled to the lock, and a child-resistant access-control unit comprising mask means for covering a portion of the fixture lock unit to conceal the operative movable lock actuator from a child that is observing the fixture, the mask means is configured to cover a portion of the fixture lock unit without blocking movement of the operative movable lock actuator relative to the fixture to actuate and unlock the lock, and the mask means is further configured for transmitting an external force applied to an exterior surface of the mask means by a caregiver to the operative movable lock actuator to cause the concealed movable lock actuator to move relative to the fixture to actuate the lock, and a non-operative decoy lock-actuator button mounted in a visible location on the mask means for movement relative to the mask means from a normal projected position to a temporary depressed position without causing movement of the operative movable lock actuator concealed by the mask means relative to the fixture sufficient to actuate the lock and unlock the fixture lock unit so that the operative movable lock actuator will not move to actuate the lock and unlock the fixture lock unit in response to movement of the decoy lock-actuator button from the normal projected position to the temporary depressed position.

2. The fixture security system of claim 1, wherein the non-operative decoy lock-actuator button is made of an elastic deformable material that is configured normally to assume the normal projected position and is deformed elastically when exposed to an external force to assume the temporary depressed position.

3. The fixture security system of claim 2, wherein the mask means is formed to include a central aperture, the non-operative decoy lock-actuator button includes a supported portion that mates with an underlying section of the mask means that surrounds the central aperture and an unsupported portion that is mated with the supported portion and suspended in an unsupported position aligned with the central aperture formed in the mask means, and the unsupported portion is arranged to move downwardly into the central aperture formed in the mask means during movement of the non-operative decoy lock-actuator button from the normal projected position to the temporary depressed position in response to exposure of an upwardly facing exterior surface of the unsupported portion to a downwardly directed external force.

4. The fixture security system of claim 3, wherein the mask means includes an outer shell formed to include an interior region sized to receive the lock and the operative movable lock actuator concealed in the interior region of the outer shell, and the outer shell includes a top wall formed to include the central aperture.

5. The fixture security system of claim 4, wherein the supported portion of the non-operative decoy lock-actuator button is mated to the top wall of the outer shell.

6. The fixture security system of claim 1, wherein the mask means includes an outer shell formed to include an interior region sized to receive the lock and the operative movable lock actuator concealed in the interior region of the outer shell, the outer shell is formed to include a button-receiving aperture opening into the interior region of the outer shell, and the non-operative decoy lock-actuator button is mounted for movement relative to the outer shell in the button-receiving aperture formed in the outer shell.

7. The fixture security system of claim 6, the mask means further includes a spring acting against the non-operative decoy lock-actuator button to urge the non-operative decoy lock-actuator button normally and yieldably to assume the normal projected position.

8. The fixture security system of claim 6, wherein the non-operative decoy lock-actuator button includes a pad having visible outer fingertip end arranged to be touched by a finger of a child attempting to actuate the lock and thereby unlock the fixture lock unit covered by the outer shell and spring means for yieldably urging the pad to move relative to the outer shell away from the temporary depressed position to the normal projected position so that the non-operative decoy lock-actuator button will be returned automatically to the normal projected position after being pushed by a child attempting to use the non-operative decoy lock-actuator button to actuate lock and unlock a fixture lock unit covered by the outer shell.

9. The fixture security system of claim 1, wherein a force-transmission section of the mask means is arranged to lie in confronting relation to a free outer end of the operative movable lock actuator stored and concealed in an interior region of the mask means and is made of a deformable elastic material to cause the force-transmission section to deform elastically in response to application of an external force by a caregiver to an exterior surface of the force-transmission section to move the force-transmission section relative to the non-operative decoy lock-actuator button to engage and move the operative movable lock actuator of the fixture lock unit relative to the mask means from an unactuated position allowing the lock to remain locked to an actuated position actuating the lock and unlocking the fixture lock unit.

10. The fixture security system of claim 9, wherein the non-operative decoy lock-actuator button is mounted for movement relative to the force-transmission section between the normal projected position and the temporary depressed position without causing movement of the operative movable lock actuator relative to the fixture to actuate the lock and unlock the fixture lock unit.

11. The fixture security system of claim 9, wherein the mask means includes an outer shell formed to include an interior region sized to receive the lock and the operative movable lock actuator concealed in the interior region of the outer shell, the outer shell includes a top wall formed to include a button-receiving aperture and a side wall arranged to depend from a perimeter edge of the top wall and formed to include the transmission section, and the non-operative decoy lock-actuator button is mounted for movement relative to the outer shell between the normal projected position and the temporary depressed position.

12. The fixture security system of claim 11, wherein the non-operative decoy lock-actuator button is made of an elastic deformable material that is configured normally to assume the normal projected position and is deformed elastically when exposed to an external force to assume the temporary depressed position.

13. The fixture security system of claim 11, wherein the mask means further includes a spring acting against the non-operative decoy lock-actuator button normally and yieldably to assume the normal projected position.

14. The fixture security system of claim 1, wherein the mask means further includes symbol means for providing a symbol on an exterior surface of the force-transmission section that is recognizable by the caregiver to identify the location of the operative movable lock actuator of the fixture lock unit stored and concealed inside the interior region of the mask means so that the caregiver can apply an external force to a force-transmission section of the mask means lying in confronting relation to the operative movable lock actuator to deform the mask means and move a portion of the mask means relative to the non-operative decoy lock-actuator button to engage and move the operative movable lock actuator of the fixture lock unit relative to the mask means from an unactuated position allowing the lock to remain locked to an actuated position actuating lock and unlocking the fixture lock unit.

15. A fixture security system for a fixture formed to include an article-storage receptacle, the fixture security system comprising a lock-unit anchor adapted to be coupled to a first portion of the fixture, a fixture lock unit including a fixture link adapted to be coupled permanently or temporarily to a second part of the fixture that is movable relative to the first part of the fixture to allow access to the article-storage receptacle formed in the fixture, a lock support, a lock mounted for movement relative to the lock support between an engaged position engaging the fixture link to block movement of the lock support relative to the fixture link and thereby lock the fixture lock unit and a disengaged position disengaging the fixture link to free the lock support to be separated and moved away from the fixture link and thereby unlock the fixture lock unit, and an operative movable lock actuator mounted for movement relative to the lock support from a first position to a second position to actuate the lock causing the lock to move from the engaged position to the disengaged position so as to unlock the fixture lock unit and allow relative movement of the first and second parts of the fixture to gain access to the article-storage receptacle formed in the fixture, and a child-resistant, access-control unit including a lock-actuator mask arranged relative to the lock support to conceal the operative movable lock actuator from a child that is observing the fixture without blocking movement of the operative movable lock actuator to actuate the lock, and a non-operative decoy lock-actuator button mounted in a visible location on the lock-actuator mask for movement relative to the lock-actuator mask from a first position to a second position without causing movement of the operative movable lock actuator relative to the lock support to actuate the lock and unlock the fixture lock unit.

16. The fixture security system of claim 15, wherein the lock-actuator mask includes an outer shell formed to include an interior region sized to receive the lock and the operative movable lock-actuator therein and the non-operative decoy lock-actuator button is movable relative to the outer shell between the first and second positions.

17. The fixture security system of claim 16, wherein the non-operative decoy lock-actuator button includes a visible outer fingertip end arranged to be touched by a finger of a child attempting to actuate the lock and thereby unlock the fixture lock unit covered by the outer shell.

18. The fixture security system of claim 16, wherein the non-operative decoy lock-actuator button is made of an elastic deformable material that is configured normally to assume the first position and is deformable elastically when exposed to an external force to assume the second position.

19. The fixture security system of claim 18, wherein the lock-actuator mask and the non-operative decoy lock-actuator button cooperate to form a monolithic component.

20. The fixture security system of claim 16, wherein the outer shell is formed to include a button-receiving aperature and the non-operative decoy lock-actuator button includes a pad that is mounted for movement relative to the outer shell in the button-receiving aperture formed in the outer shell.

21. The fixture security system of claim 20, wherein the non-operative decoy lock-actuator button further includes a spring acting against the pad to urge the pad to move relative to the outer shell to establish the first position of the non-operative decoy lock-actuator button.

22. The fixture security system of claim 16, wherein a force-transmission section of the outer shell is arranged to lie in confronting relation to a free outer end of the operative movable lock actuator concealed in the outer shell and the force-transmission section is made of a deformable elastic material to cause the force-transmission section to deform elastically in response to application of an external force by a caregiver to an exterior surface of the force-transmission section to move the force-transmission section relative to the decoy lock-actuator button to engage and move the operative movable lock actuator relative to the outer shell from the first position to the second position to actuate the lock and thereby actuate the fixture lock unit.

23. The fixture security system of claim 15, wherein a force-transmission section of the lock-actuator mask is arranged to lie in confronting relation to a free outer end of the operative movable lock actuator concealed in the lock-actuator mask and the force-transmission section is made of a deformable elastic material to cause the force-transmission section to deform elastically in response to application of an external force by a caregiver to an exterior surface of the force-transmission section to move the force-transmission section relative to the decoy lock-actuator button to engage and move the operative movable lock actuator relative to the lock-actuator mask from the first position to the second position to actuate the lock and thereby actuate the fixture lock unit.

* * * * *